US010759550B2

(12) United States Patent
Anderson et al.

(10) Patent No.: US 10,759,550 B2
(45) Date of Patent: Sep. 1, 2020

(54) INTERMITTENT CASE PACKER ASSEMBLY AND METHODS

(71) Applicant: Douglas Machine Inc., Alexandria, MN (US)

(72) Inventors: David L. Anderson, Alexandria, MN (US); Christopher T. Davis, Alexandria, MN (US); Daniel L. Floding, Alexandria, MN (US); Craig D. Sholts, Alexandria, MN (US)

(73) Assignee: Douglas Machine Inc., Alexandria, MN (US)

( * ) Notice: Subject to any disclaimer, the term of this patent is extended or adjusted under 35 U.S.C. 154(b) by 755 days.

(21) Appl. No.: 15/275,611

(22) Filed: Sep. 26, 2016

(65) Prior Publication Data

US 2017/0101200 A1 Apr. 13, 2017

Related U.S. Application Data

(60) Provisional application No. 62/233,104, filed on Sep. 25, 2015.

(51) Int. Cl.

| | |
|---|---|
| ***B65B 5/06*** | (2006.01) |
| ***B65B 35/40*** | (2006.01) |
| ***B65B 59/00*** | (2006.01) |

(52) U.S. Cl.

CPC ..... *B65B 5/06* (2013.01); *B65B 35/40* (2013.01); *B65B 59/00* (2013.01)

(58) Field of Classification Search

CPC ..... B65B 5/06; B65B 35/40; B65B 59/00

(Continued)

(56) References Cited

U.S. PATENT DOCUMENTS 2,463,576 A * 3/1949 Strickler ..... B65B 69/00 53/255
2,891,361 A * 6/1959 Walter ..... B65B 5/06 53/157

(Continued)

FOREIGN PATENT DOCUMENTS

| | | |
|---|---|---|
| WO | 2014079525 A1 | 5/2014 |
| WO | 2014096589 A1 | 6/2014 |
| WO | 2014190966 A1 | 12/2014 |

*Primary Examiner* — Nathaniel C Chukwurah
*Assistant Examiner* — Lucas E. A. Palmer
(74) *Attorney, Agent, or Firm* — Dicke, Billig & Czaja, PLLC

(57) ABSTRACT

A system for loading an accumulated article group into a case is provided. The system includes an article accumulation station, a grouped article loading station, and a pusher assembly. The accumulation station includes an article receiver assembly in furtherance of delimiting an accumulated article group, and a grouped article guide structure within which the accumulated article group is positionable by operation of the article receiver assembly. The grouped article loading station includes a gate assembly, having first and second operable configurations, and an actuatable gate through which the accumulated article group passes during loading of the group into a case presented for receipt of same. The pusher assembly includes an actuatable pusher for effectuating a transfer of the accumulated article group from the accumulation station to the loading station, flat packing operations effectuated via transfer of the grouped article guide structure over the actuatable gate of the first operably configured pivotable gate assembly by the pusher, vertical packing operations effectuated via transfer of the accumulated article group to the actuatable gate of the second operably configured pivotable gate assembly.

36 Claims, 19 Drawing Sheets

(58) Field of Classification Search
USPC ..... 53/147, 443
See application file for complete search history.

(56) References Cited

U.S. PATENT DOCUMENTS 3,068,624 A * 12/1962 Linda ..... B65B 5/06 53/523
3,270,485 A * 9/1966 Knepper ..... B65B 67/04 186/66
3,665,674 A * 5/1972 Bivans ..... B65B 5/06 53/202
4,750,317 A * 6/1988 Vrana ..... B65B 5/06 53/247
4,823,539 A * 4/1989 Kuckhermann ..... B65B 59/00 198/465.2
5,175,014 A * 12/1992 Brockwell ..... A01J 25/162 426/512
5,251,422 A 10/1993 Goodman et al.
5,778,640 A 7/1998 Prakken et al.
5,813,195 A * 9/1998 Nielsen ..... B65B 1/32 177/119
5,813,196 A 9/1998 Page et al.
6,164,045 A * 12/2000 Focke ..... B65B 5/105 198/429
6,174,122 B1 * 1/2001 Krooss ..... B65B 69/0033 414/404
6,430,895 B1 8/2002 Kitagawa et al.
6,574,943 B2 6/2003 Van Dam
6,622,848 B1 9/2003 Lattimer et al.
6,637,174 B1 * 10/2003 Dietrich ..... B65B 5/06 53/250
6,668,522 B2 12/2003 Prakken
6,694,706 B1 2/2004 Odenthal et al.
6,725,629 B2 4/2004 Pearce et al.
6,746,015 B2 6/2004 Lehmann
6,974,299 B2 12/2005 Prakken et al.
7,096,650 B2 8/2006 Van Dam
2002/0069618 A1 * 6/2002 Otsuka ..... B65B 5/067 53/434
2002/0073658 A1 6/2002 Huang et al.
2003/0136086 A1 7/2003 Kalany et al.
2003/0136641 A1 7/2003 Iwasa et al.
2004/0084279 A1 5/2004 Holston et al.
2004/0226260 A1 11/2004 Yokota et al.
2006/0037284 A1 2/2006 Sandberg et al.
2006/0070353 A1 * 4/2006 Van Dam ..... B65B 5/061 53/447
2006/0180434 A1 8/2006 Arnold et al.
2007/0157549 A1 7/2007 van Beusekom
2007/0209327 A1 9/2007 Kent et al.
2007/0256909 A1 11/2007 Shimomae et al.
2008/0053039 A1 * 3/2008 Vissers ..... B65B 5/06 53/247
2008/0072549 A1 3/2008 Vissers
2009/0249750 A1 10/2009 Black et al.
2009/0277133 A1 11/2009 Yokota et al.
2009/0283385 A1 11/2009 Takayama et al.
2009/0308024 A1 12/2009 Yokota et al.
2010/0115886 A1 5/2010 Takayama et al.
2010/0170196 A1 7/2010 Iwasa et al.
2010/0170201 A1 7/2010 Aquarius
2010/0205913 A1 8/2010 Iwasa et al.
2011/0005174 A1 1/2011 Prahm et al.
2011/0023422 A1 2/2011 Takayama et al.
2011/0167771 A1 7/2011 Till et al.
2011/0302882 A1 12/2011 Brunes et al.
2012/0006651 A1 1/2012 Cote
2013/0008762 A1 * 1/2013 Gust ..... B65B 5/061 198/412
2013/0174514 A1 * 7/2013 Wilkinson ..... B65B 23/00 53/249
2013/0283731 A1 * 10/2013 Komp ..... B65B 5/06 53/268
2014/0083062 A1 * 3/2014 Arimatsu ..... B65B 35/44 53/564
2015/0013277 A1 * 1/2015 Brandhorst ..... B65B 35/18 53/475
2015/0298842 A1 * 10/2015 Yokota ..... B65B 43/54 53/458
2015/0329230 A1 * 11/2015 Rasi ..... B65B 25/146 53/443
2017/0096244 A1 * 4/2017 Serra ..... B65B 35/46

* cited by examiner

INTERMITTENT CASE PACKER ASSEMBLY AND METHODS

CROSS-REFERENCE TO RELATED APPLICATIONS

This is a United States national utility patent application filed pursuant to 35 USC § 111(a) claiming priority under 35 USC § 120 of/to U.S. Pat. Appl. Ser. No. 62/233,104 filed Sep. 25, 2015 and entitled INDIVIDUAL QUICK FROZEN FOOD INTERMITTENT CASE PACKER ASSEMBLY & METHODS, the disclosure of which is hereby incorporated by reference in its entirety.

TECHNICAL FIELD

The present invention is generally directed to one or more of systems, subsystems, apparatuses, assemblies, subassemblies, and/or methods for intermittent case packing. More particularly, the instant disclosure is notionally directed to the one or more of systems, subsystems, apparatuses, assemblies, and subassemblies (and/or related methods), configurable for each of flat and vertical packing operations, and contextually, and without limitation, to flexible article, e.g., bagged individual quick frozen food articles, packing.

BACKGROUND

It is well known that frozen food packaging must maintain its integrity throughout machine filling, sealing, freezing, storage, packing, transportation, thawing, and often cooking. Improvements in food handling, preparation and freezing has enabled a heretofore unseen variety of foodstuff to be widely available and desirable.

In the culinary arts, the term IQF stands for "individually quick frozen." IQF foods are notable for the fact that each individual piece of food is frozen separately from all the others, thus defeating both real and perceived drawbacks and making such foodstuff easier to work with. Non-limiting examples of IQF foods are fruits (e.g., and especially, blueberries, strawberries and peaches); vegetables such as corn, peas and green beans; seafood such as shrimp and scallops; or poultry, such as individual chicken parts such as breast, tenders or wings; and, processed potatoes, commonly in the form of "fries."

Whether in the context of IQF foodstuff or otherwise, flexible bags or the like are becoming/have become especially favored. Both commercial and retail offerings from a single source/provider are the norm, with a variety of package styles, configurations, and/or sizes for each category of purchaser. Needless to say, with the current state of affairs, a one-size-fits-most case packing system has gone the way of the dinosaur. There remains a need to at least maintain, if not improve upon system processing versatility characterized by minimal downtime, change parts etc. Moreover, there remains a need to reduced mechanical and/or operational complexity, minimize a footprint for such system, and provided an alternative to what are generally high cost robotic solutions.

SUMMARY

A system for loading an accumulated article group into a case is provided. The system is advantageously characterized by assemblies that are readily and quickly configurable and reconfigurable for high throughput flat and vertical packing operations. The system generally includes an article accumulation station, a grouped article loading station, and a pusher assembly.

The accumulation station is characterized by an article receiver assembly for selective aggregating receipt of articles in furtherance of delimiting an accumulated article group. The accumulation station is further characterized by a grouped article guide structure within which the accumulated article group is positionable by operation of the article receiver assembly.

The grouped article loading station is characterized by a gate assembly having first and second operable configurations. The gate assembly includes an actuatable gate, the accumulated article group passing through the actuatable gate during loading of the accumulated article group into a case presented for receipt of the accumulated article group.

The pusher assembly is characterized by an actuatable pusher effectuating a transfer of the accumulated article group from the accumulation station to the grouped article loading station. Flat packing operations are effectuated via transfer of the grouped article guide structure, and thus the accumulated article group therein, over the actuatable gate of the first operable configuration for the pivotable gate assembly by the pusher. Vertical packing operations are effectuated via transfer of the accumulated article group to the actuatable gate of the second operable configuration of the pivotable gate assembly. Via contemplated, minimal, change parts and operatively robust elements such as, but not limited to a grouped article guide structure of an article accumulation station, and a selective orientable gate assembly of a grouped article loading station, a relatively small footprinted system possessing supreme reliability for the either of flat or vertical pack processing of a wide dimensional range of articles characterized by flexible containers (e.g., bags), with resort to expensive robotics, is provided. More specific features and advantages obtained in view of those features will become apparent with reference to the drawing figures and DETAILED DESCRIPTION OF THE INVENTION.

BRIEF DESCRIPTION OF THE DRAWINGS

All figures have been prepared, and are included to facilitate and/or enhance an understanding of the basic teachings of the contemplated embodiments, and/or the concepts underlying same and are incorporated in and constitute a part of this specification. While the drawings illustrate embodiments and context with respect thereto, and together with the description serve to explain principles of embodiments, other embodiments and many of the intended advantages of the disclosed systems, subsystems, assemblies, subassemblies, mechanism, etc. will be readily appreciated as they become better understood by reference to the following detailed description and figures. It is to be noted that the elements of the drawings are not necessarily to scale relative to each other, with like reference numerals designating corresponding similar parts/structures.

DETAILED DESCRIPTION

Preferred, non-limiting systems, subsystems, assemblies, subassemblies, structures and/or mechanism are generally shown and described in connection to a preferred, non-limiting intermittent case packer, advantageously, but not necessarily, an intermittent case packer, more particularly, a case packer configurably convertible for and between flat and vertical pack operations. Prior to a presentation of particulars, preliminary remarks are provided as to the depictions of the figures herein.

Figure 1:
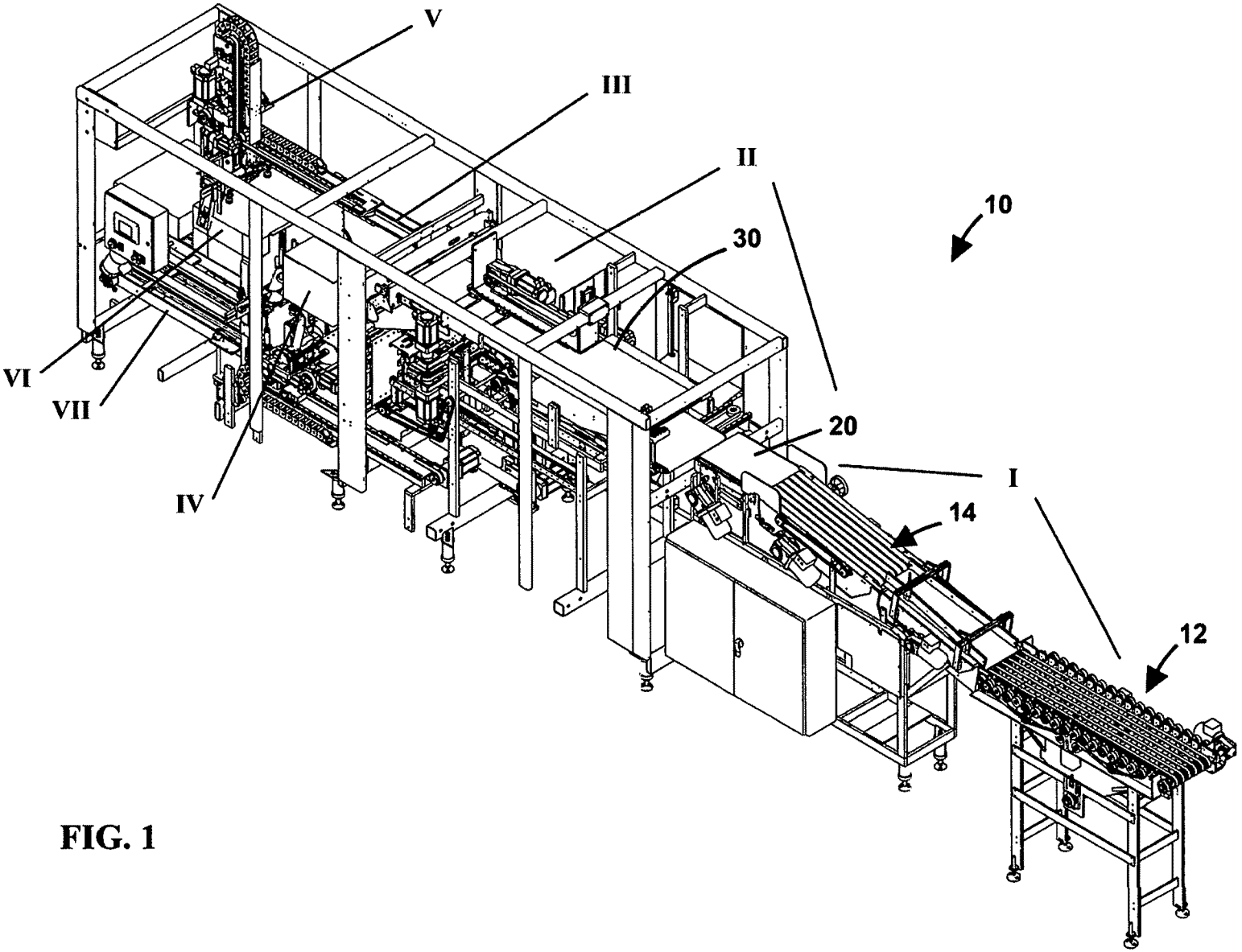
FIG. 1 generally depicts a contemplated, non-limiting convertible intermittent case packer system, shown configured for "flat" pack operations, process flow right to left, advantageously but not necessarily characterized by processing areas I-VII generally corresponding to: (I) article conditioning; (II) article infeeding; (III) article accumulation/grouping; (IV) case erection and presentation; (V) case blank pick-up via a blank gantry assembly; (VI) a case blank magazine; and, (VII) a packed case outflow.
Figure 15:
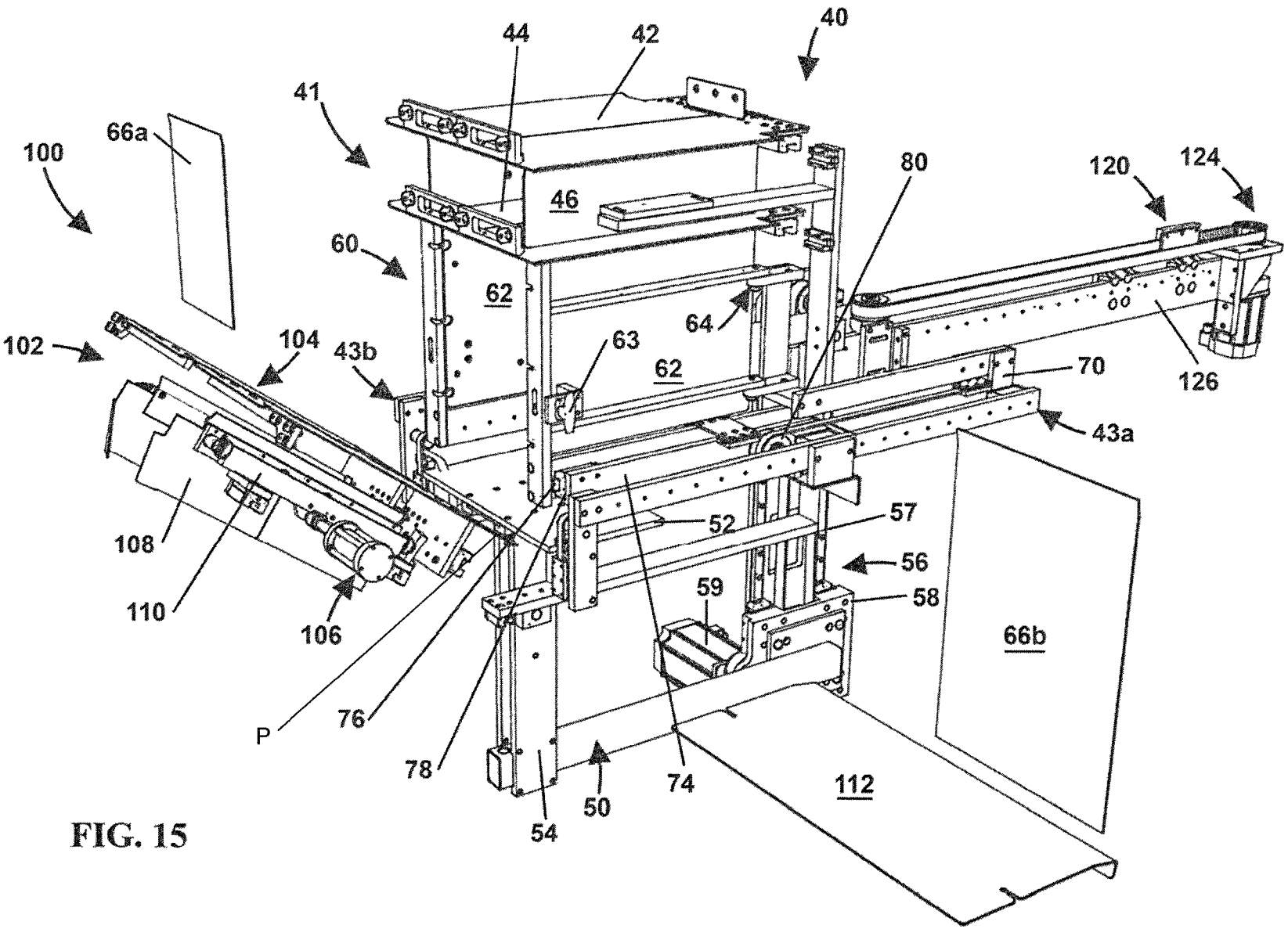
FIG. 15 depicts conversion of the FIG. 11 subassembly in furtherance carrying out vertical packing operations, a gate assembly thereof illustrated in pivoting transition to a vertical orientation from a horizontal orientation, with disintegrated conversion elements/structures nonetheless shown.

A contemplated, non-limiting convertible intermittent case packer system, configured for "flat" pack operations, is generally illustrated in FIG. 1 wherein the system is advantageously but not necessarily characterized by processing areas I-VII generally corresponding to: (I) article conditioning (i.e., pre-conditioning, e.g., settling of article (e.g., package/bag) contents and air evacuation of same to substantially conform the package/bag to the contents); (II) article infeeding; (III) article accumulation/grouping; (IV) case erection and presentation; (V) case blank pick-up via a blank gantry assembly; (VI) a case blank magazine; and, (VII) a packed case outflow. The system of FIG. 1, area I elements omitted and parts removed to reveal process flow clarity, is next shown, two views (FIGS. 2 & 3), with processing areas II & IV subsequently emphasized (FIG. 4). Thereafter, an operational processing sequence for the FIG. 2 subsystem is illustrated (FIGS. 5-10), with a functional operation sequence associated with subassemblies of processing areas III & IV, operatively configured for article group flat packaging operations (FIGS. 11-14) and article group vertical packing operations (FIGS. 16 & 17) thereafter provided, a subassembly conversion depiction (i.e. in furtherance of changing between flat and vertical article group packing operations) is likewise provided (FIG. 15). Finally, hidden elements of the FIG. 16 vertical pack subassembly are readily appreciated in the depictions of FIGS. 18 & 19.

With initial general reference to the depictions of FIGS. 1-4, and reference thereafter to the sequence of FIGS. 5-10, discussion will proceed with regard to article accumulation/grouping, grouped article transfer, and grouped article case loading. More particularly, such discussion proceeds in connection to processing areas III & IV, with reference to horizontal/flat pack operations as depicted.

Figure 2:
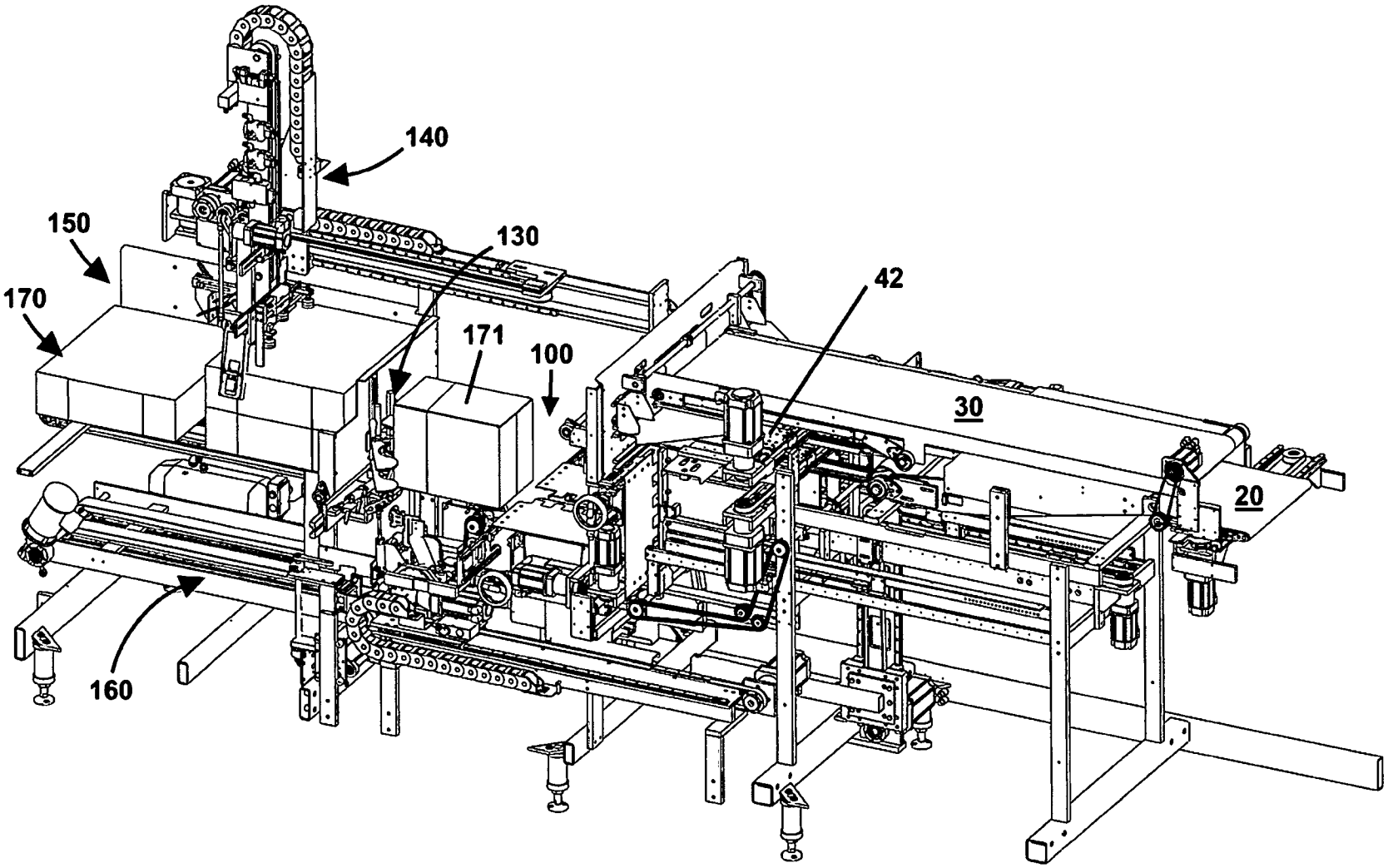
FIG. 2 depicts a subsystem of the FIG. 1 convertible intermittent case packer system, more particularly, operative assemblies corresponding to processing areas II-VII thereof, elements omitted for the sake of clarity.
Figure 3:
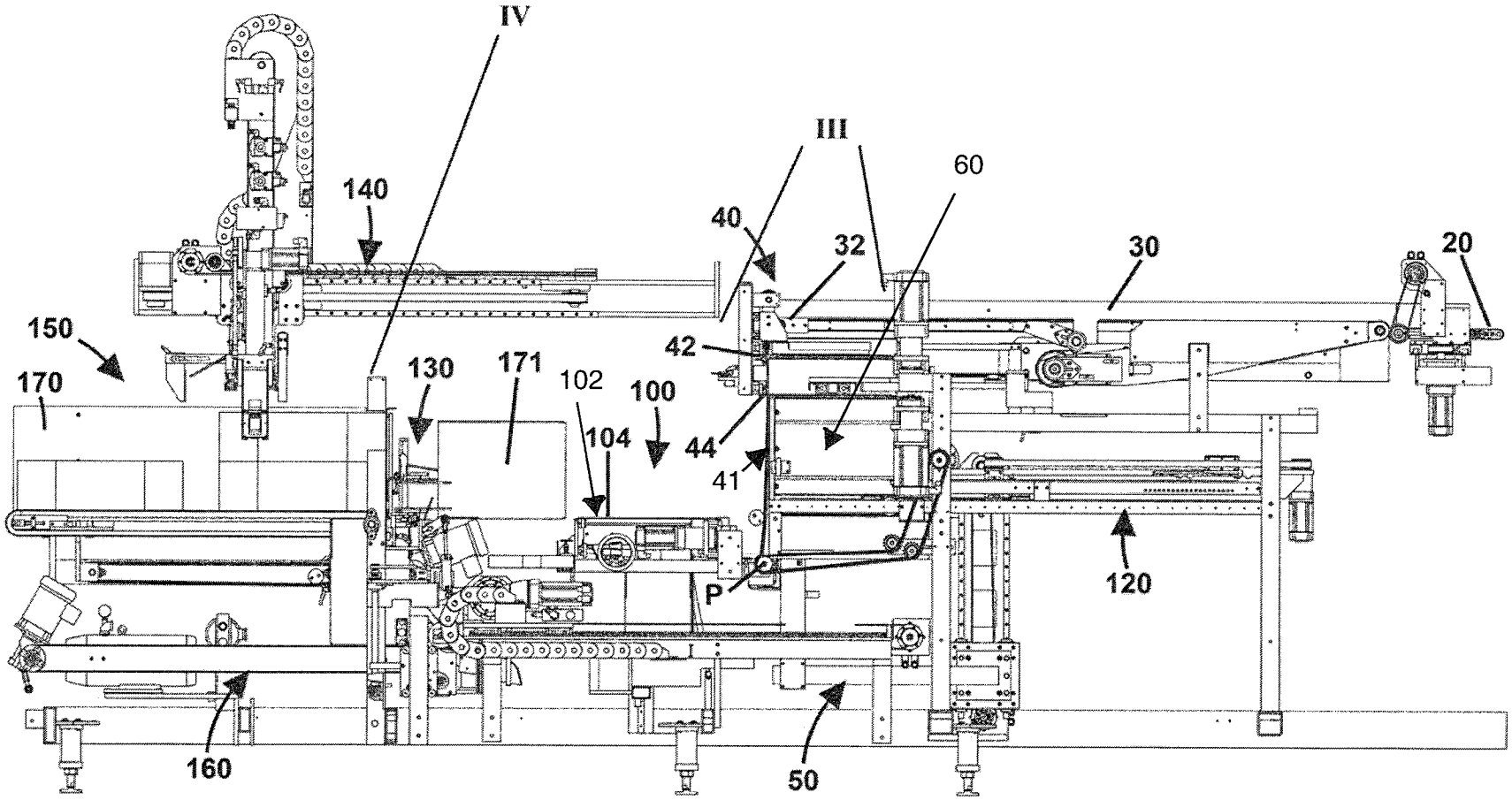
FIG. 3 is a side elevation of the FIG. 2 operative assemblies.
Figure 4:
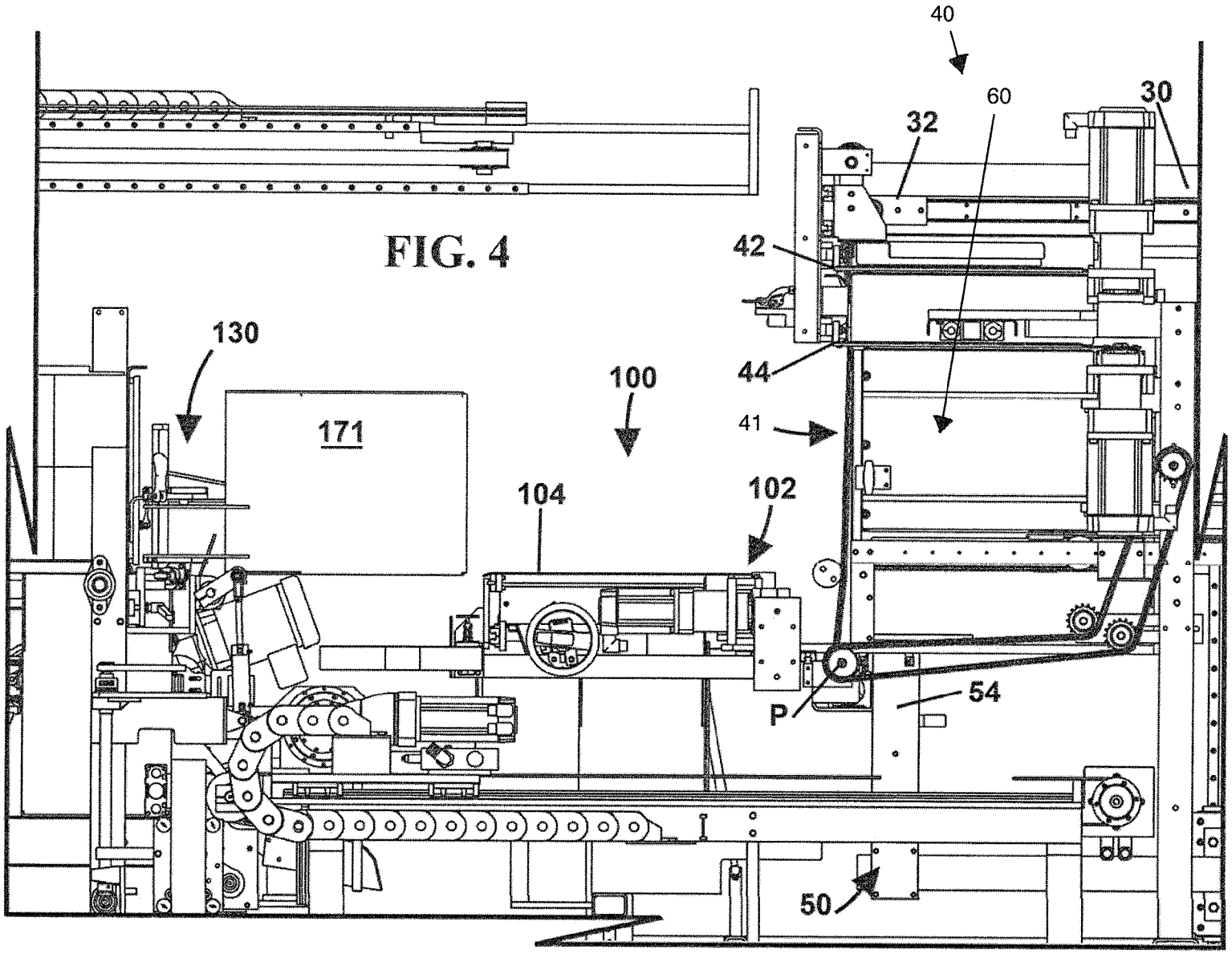
FIG. 4 is an enlarged view, FIG. 3 area 4, of the operative assemblies corresponding to processing areas III & IV of the FIG. 2 subsystem.

General processing is best appreciated with initial reference to system 10 of FIG. 1, and select reference to any of FIGS. 2-4. Commencing in processing area I, the advantageous preconditioning of articles (e.g., bags of individual quick frozen (IQF) foodstuffs such as, but hardly limited to french fries) is conducted via first 12 and second 14 preconditioning conveyors. Notionally, preconditioning aims to uniformly distribute the foodstuff in relation to its container, e.g., a bag, and to, as the case may be, evacuate the container headspace such that a flexible container closely conforms to the foodstuff. In short, preconditioning of the articles is intended to aid casing operations, and the structural integrity of a case packed with such preconditioned articles.

Post preconditioning, articles pass to a product placement conveyor 20 (see e.g., US 2013/0008762 (Gust et al.) which, owing to transverse oscillation (FIG. 2), establishes article rows for conveyance upon article infeed conveyor 30. Article grouping operations commence at the downstream-most portion of the article infeed conveyor, namely, at an article accumulation station 40. As further depicted FIG. 2, downstream processing areas area generally and fairly characterized by a grouped article loading station 100, a case erection and presentation assembly 130, a case blank gantry assembly 140, a case blank magazine 150, and a packed or loaded case outflow assembly 160.

With particular reference to FIGS. 2-4, and as is best appreciated with reference to FIG. 3, wherein processing areas III and IV are indicated in the depicted side elevation, process flow right to left, area III article accumulation/grouping is fairly characterized by a select vertical, falling transfer of articles from the infeed conveyor. More particularly, article infeed transpositing conveyor 30 conveys gapped and divided articles toward a free end portion 32 thereof adapted for translation or oscillation in the direction of article flow. Notionally, formed article rows longitudinally extend and travel toward the free end portion of the transpositing conveyor such that the downstream-most article "spills" thereover as the fully downstream extended free end portion of the transpositing conveyor is swiftly retracted in an upstream direction.

With specific reference to FIGS. 3 & 4, there is depicted an article accumulation station 40 fairly characterized and/or delimited by a chute 41. Chute 41 (i.e., a working envelope or volume if you will for the station) vertically extends downstream of transpositing conveyor 30 and upstream of operations associated with processing area IV (i.e., grouped article case loading/packing delimited by a gate assembly 102 (i.e., a chamber loader) of grouped article loading station 100).

Devices and/or subassemblies associated with article accumulation station 40, e.g., chute 41, advantageously include first 42 and second 44 actuatable layering shelves, an article receiver assembly 50, and a grouped article guide structure 60 through which a portion of the article receiver is passable in furtherance of positioning an accumulated article group within same. A pusher assembly 120 acts upon the grouped article guide structure, in the as depicted flat pack subassembly configuration, so as to registeringly position the grouped article guide structure over the gate assembly in advance of loadingly transferring guidingly grouped articles to a case below the loader.

With primary reference now to FIGS. 5-10, there is illustrated an operational sequence which exemplifies article grouping, article group transfer and transferred article group case packing. Notionally, case blanks 170 are at least partially erected during article accumulation operations, with substantially formed cases 171 transferred into a loading station or area delimited by the gate assembly 102 (i.e., the case is positioned there below) in advance of transfer of the grouped article guide structure 60 into the loading station delimited by the gate assembly (i.e., the grouped article guide structure is positioned there above) by an actuatable pusher 122 of pusher assembly 120. It is to be noted that while the subject depictions are characterized by a single shelf (i.e., shelf 42), general operation/function is nonetheless fairly illustrated.

Figure 5:
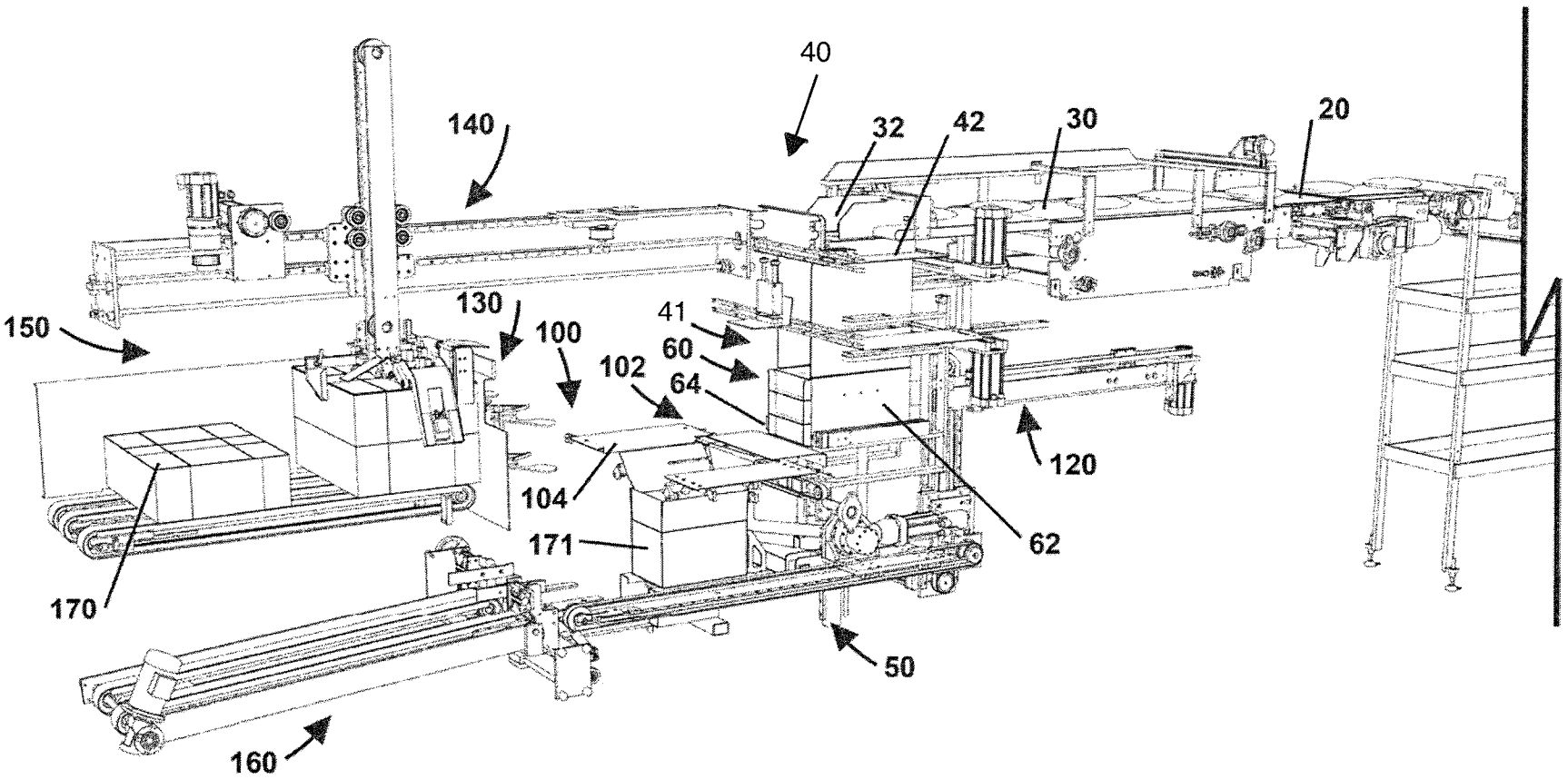
FIG. 5 depicts initial/concluding flat pack operations as per the FIG. 2 subsystem.

The operational status of FIG. 5 is one of completion/initiation. Gate 104 of gate assembly 102 is shown in an open configuration having permitted passage of an article group to the case which is shown initially exiting case presentation area IV. The gate remains open in furtherance of pivotingly accepting a substantially erect case having origins in the blank secured by overhead gantry assembly 140 as will later be appreciated in connection to subsequent disclosure. The article accumulation station is in a ready/initially active state, with an article having passed from transpositing conveyor 30 to shelf 42 via chute 41. Grouped article guide structure 60 is positioned in/at a home position, an article group platform or support 52 (not visible, but see FIGS. 6 & 7) of article receiver assembly 50 shown having been upwardly advanced from a home position, to and through grouped article guide structure 60.

Figure 6:
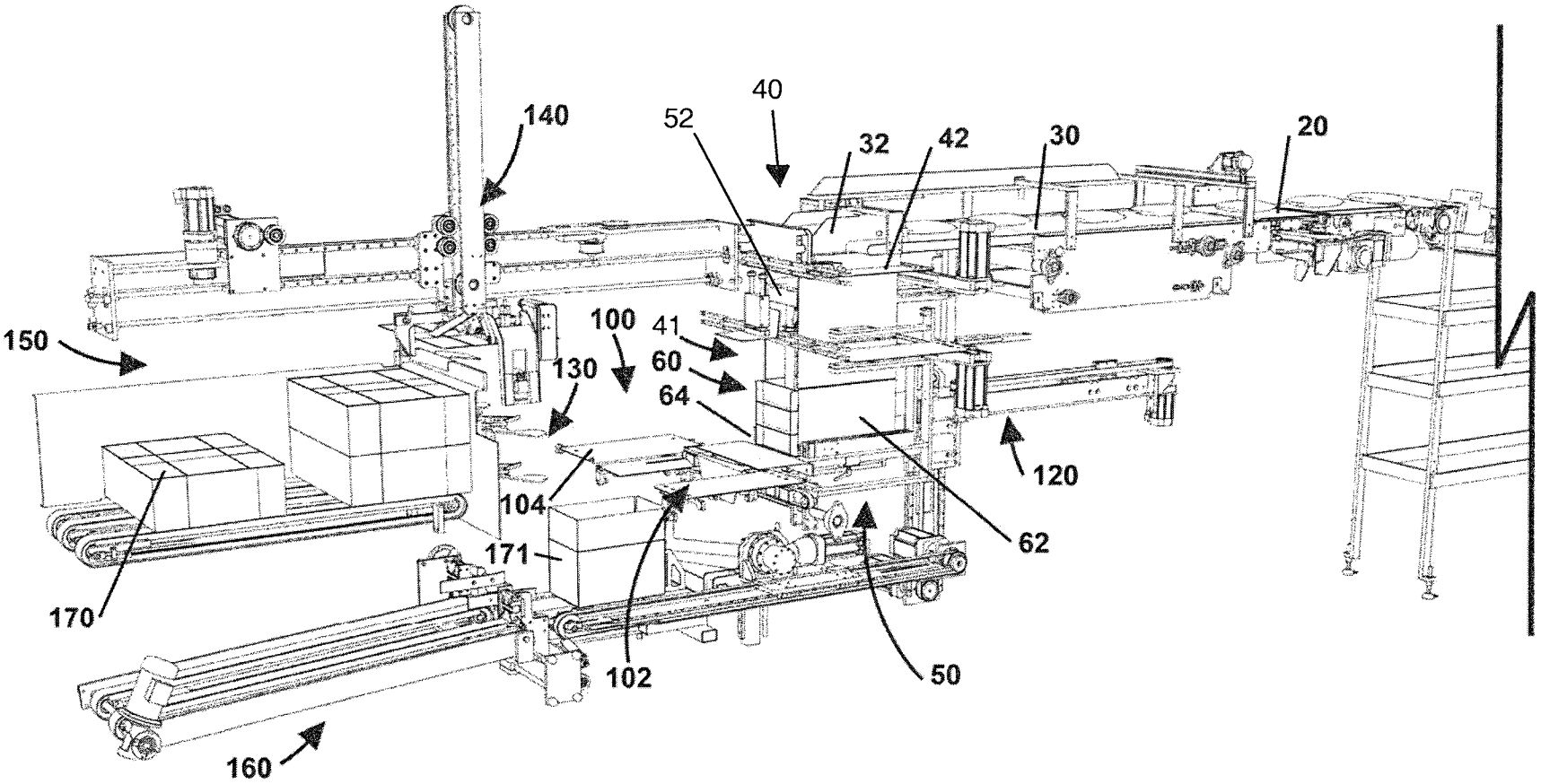
FIG. 6 depicts subsequent flat pack operations relative to FIG. 5, namely, operations characterized by initial article buffering and/or accumulation.
Figure 7:
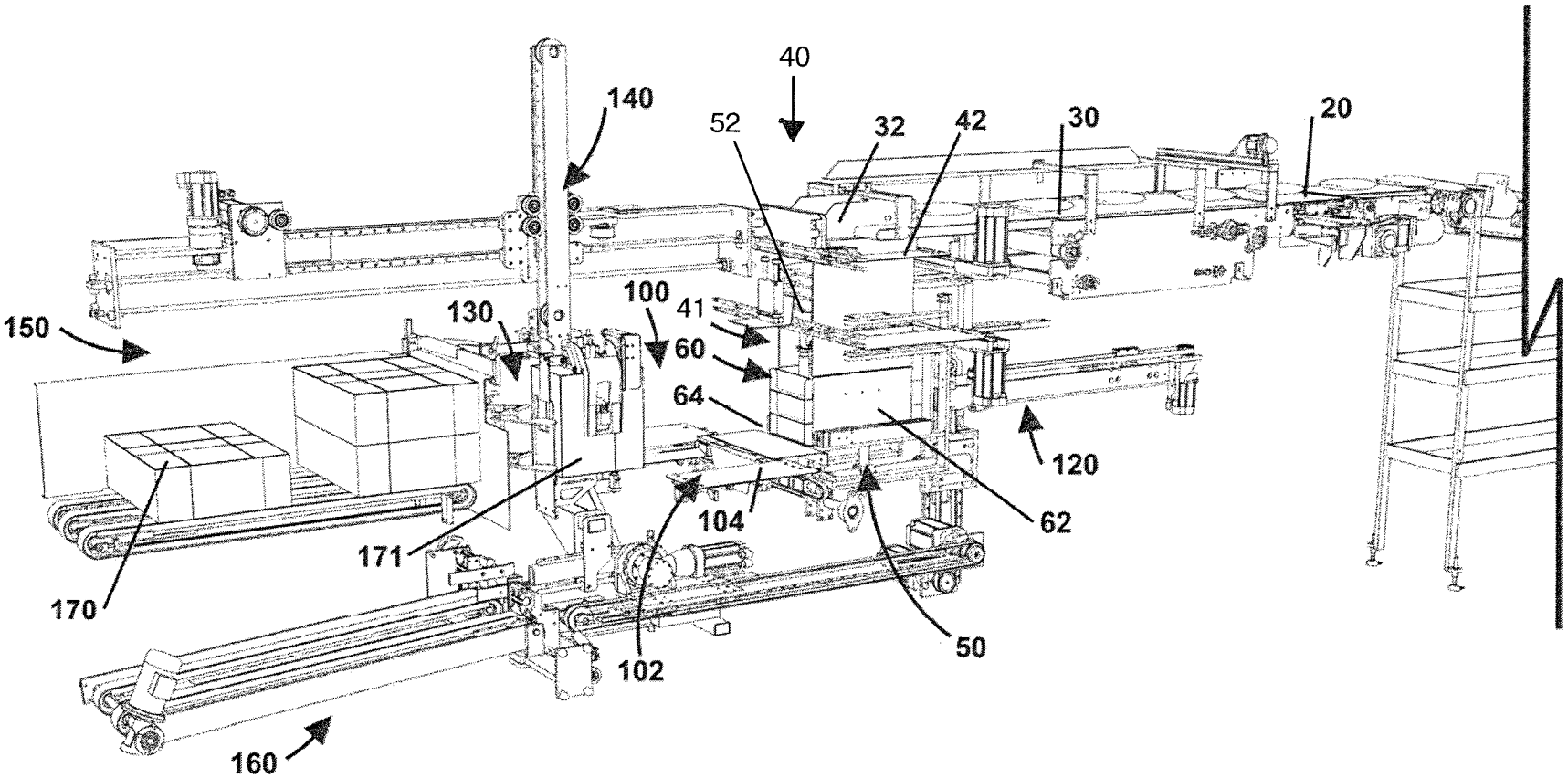
FIG. 7 depicts subsequent flat pack operations relative to FIG. 6, namely, operations characterized by further article accumulation and case erection.
Figure 8:
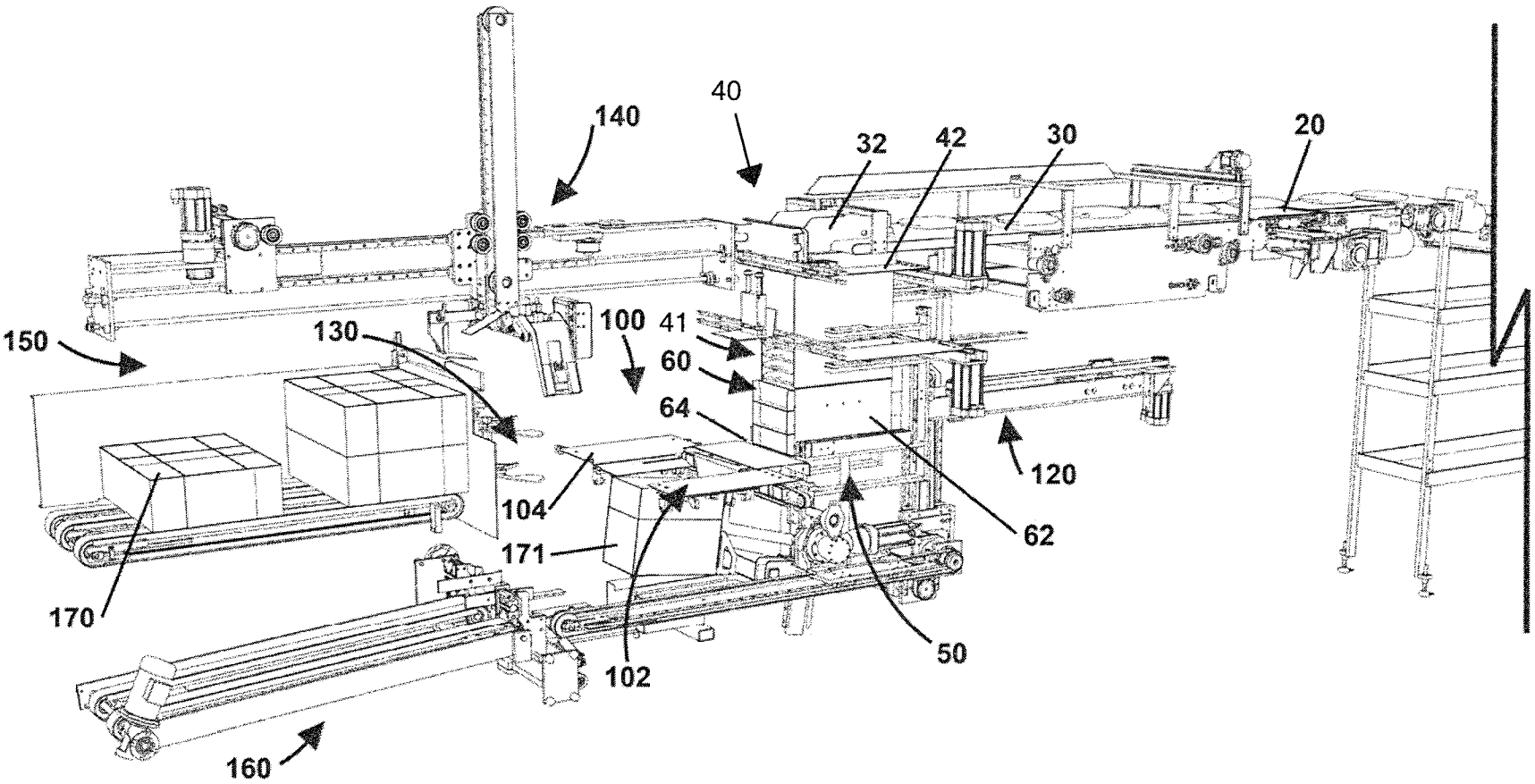
FIG. 8 depicts subsequent flat pack operations relative to FIG. 7, namely, operations characterized by an accumulated article group ready for positioning within a grouped article guide structure, and case positioning within a grouped article loading station.
Figure 9:
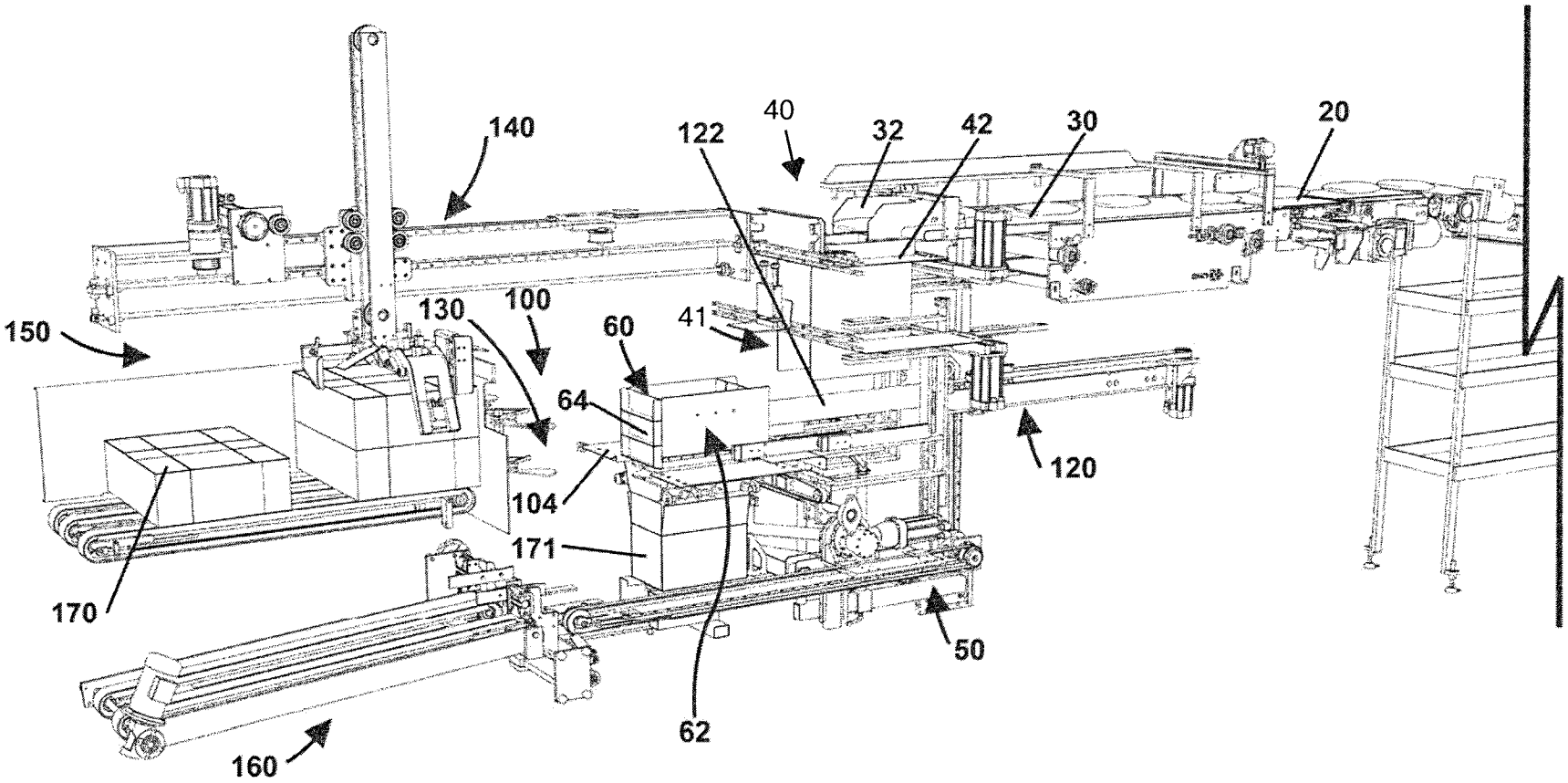
FIG. 9 depicts subsequent flat pack operations relative to FIG. 8, namely, operations characterized by case loading subsequent to the transfer of the accumulated article group from the article accumulation station to the grouped article loading station.
Figure 10:
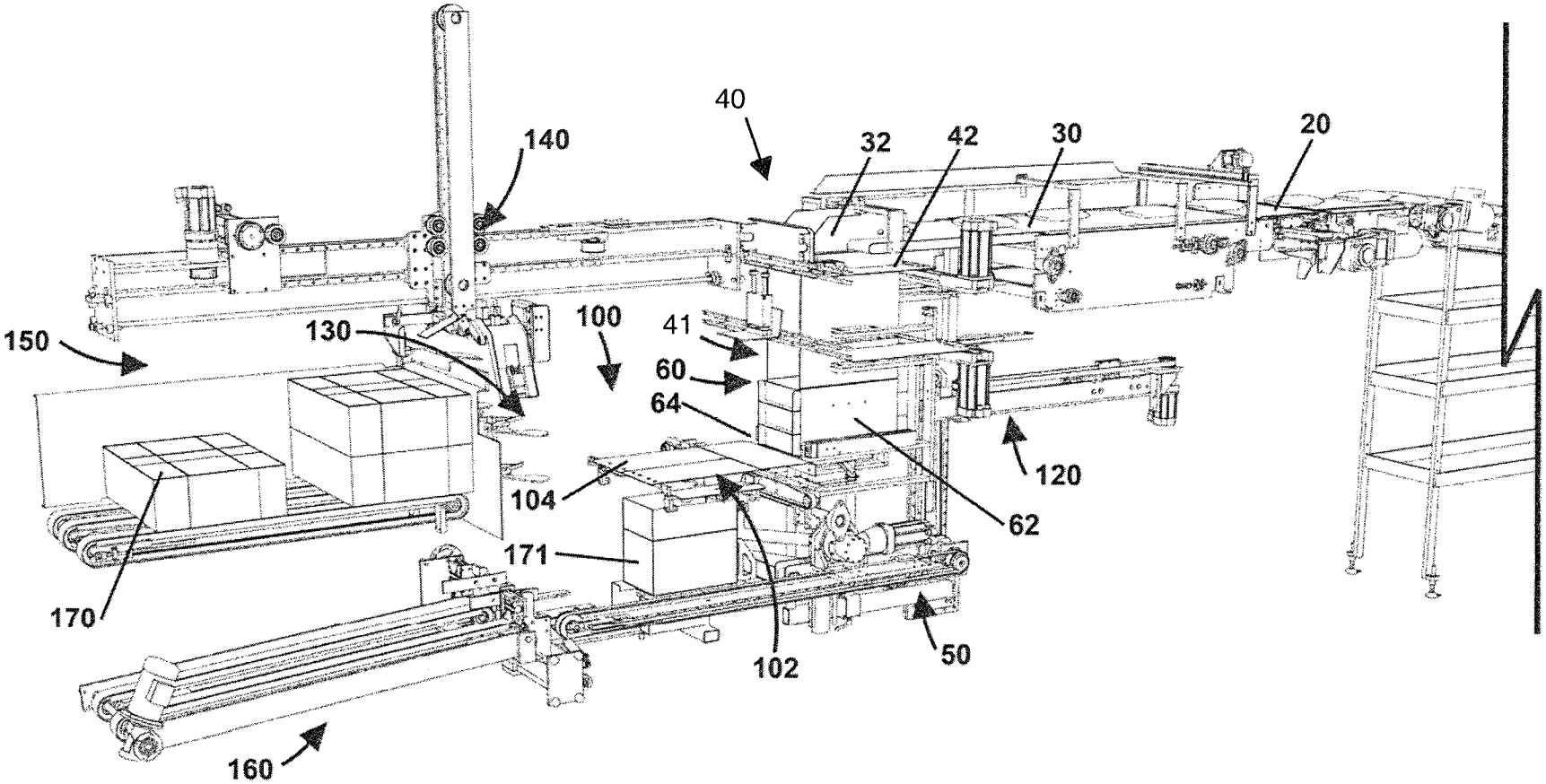
FIG. 10 depicts subsequent flat pack operations relative to FIG. 9, namely, concluded case loading.

With reference now to FIGS. 6-10, shelved articles pass to the article group platform 52 of article receiver assembly 50 (FIGS. 6 & 7). During accumulation thereon (e.g., stacking, layering, etc.), article group platform 52 is incrementally lowered, making "room" for a further/new article to the top of the pile (see/compare each of FIGS. 6-8). During accumulation of the articles, case blank 170 is partially erected (FIG. 7) and thereafter, substantially erected case 171 is pivotingly passed through gate 104 of gate assembly 102 (FIG. 8) with article group platform 52 continuing its descent into grouped article guide structure 60. Having been lowered to a preselect elevation sometime after the view of FIG. 8 but before the view of FIG. 9, the article group supported upon platform 52 of article receiver assembly 50 is circumscribed by elements of article group guide structure 60 (FIG. 9), with gate 104 of gate assembly 102 having been actuated to prohibit access to an underlying case. Next (FIG. 9), actuatable pusher 122 of pusher assembly 120 is activated so as to locate article group guide structure 60, and thus the article group essentially surrounded thereby, over top gate assembly 102, with gate 104 thereof further actuated to permit passage of the article group from guide structure 60 to the case, pusher 122 and gate 104 thereafter reverting to permit further cycling, with the loaded case ready for transfer from case presentation area IV (FIG. 10) for later processing.

With general reference now to FIG. 11-19, advantageous subassemblies of processing areas III & IV are generally illustrated (FIGS. 11-17), with select particulars therefore likewise depicted (FIGS. 18 & 19) to aid and support understanding of structures of the subassembly and/or attendant functions thereof. As previously noted, in as much as functional flow is depicted for the subassembly in relation to flat pack operations (FIGS. 11-14) and vertical pack operations (FIGS. 16 & 17), with conversion of the FIG. 11 subassembly from flat to vertical pack operations depicted (FIG. 15), discussion next proceeds in connection to the structures of each of the subassemblies depicted.

Figure 11:
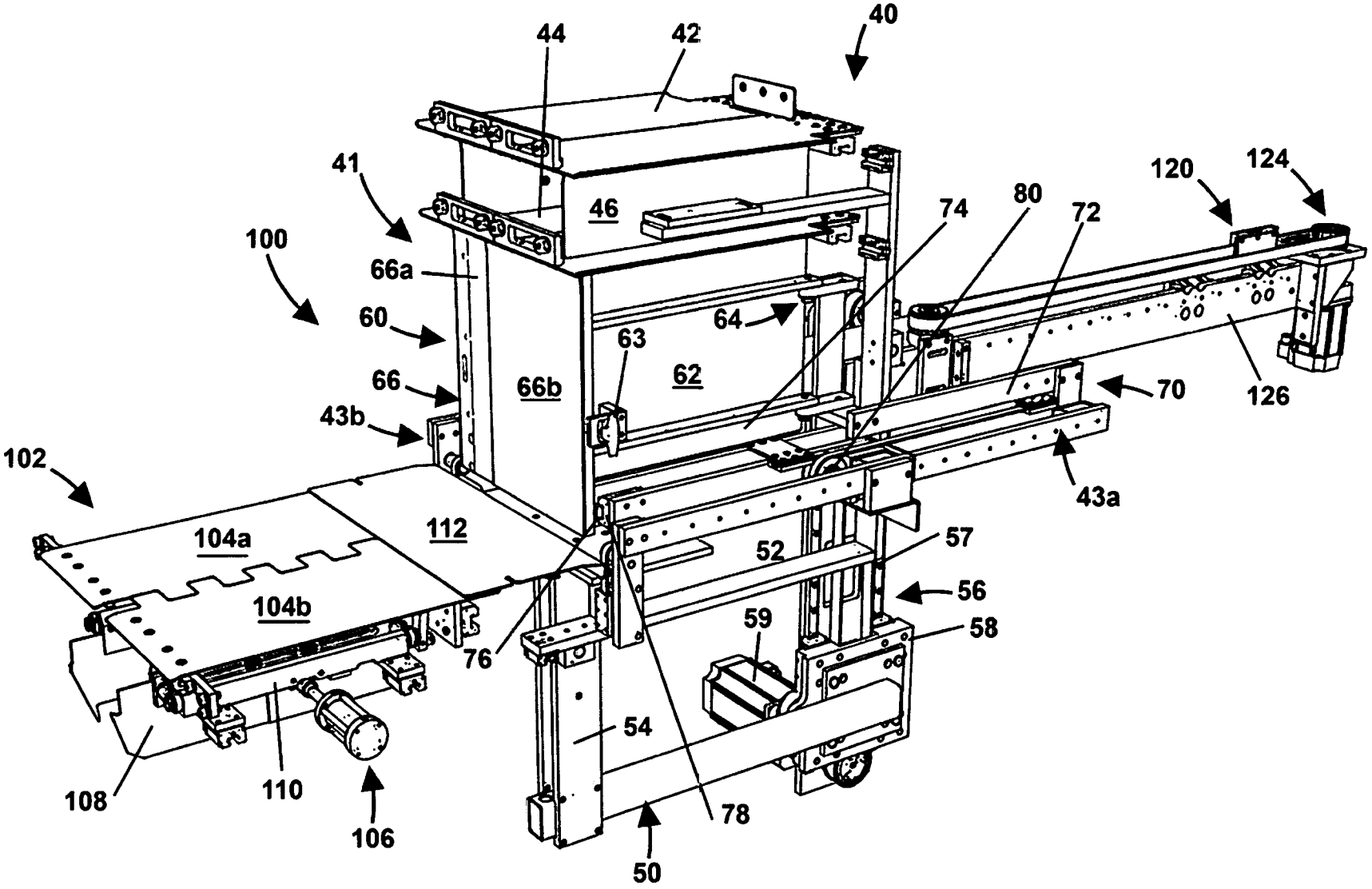
FIG. 11 generally depicts, side perspective view process flow right to left, subassemblies of processing areas III & IV of the contemplated convertible intermittent case packer operatively configured for flat packaging operations, articles being accumulated in advance of an article group transfer.
Figure 12:
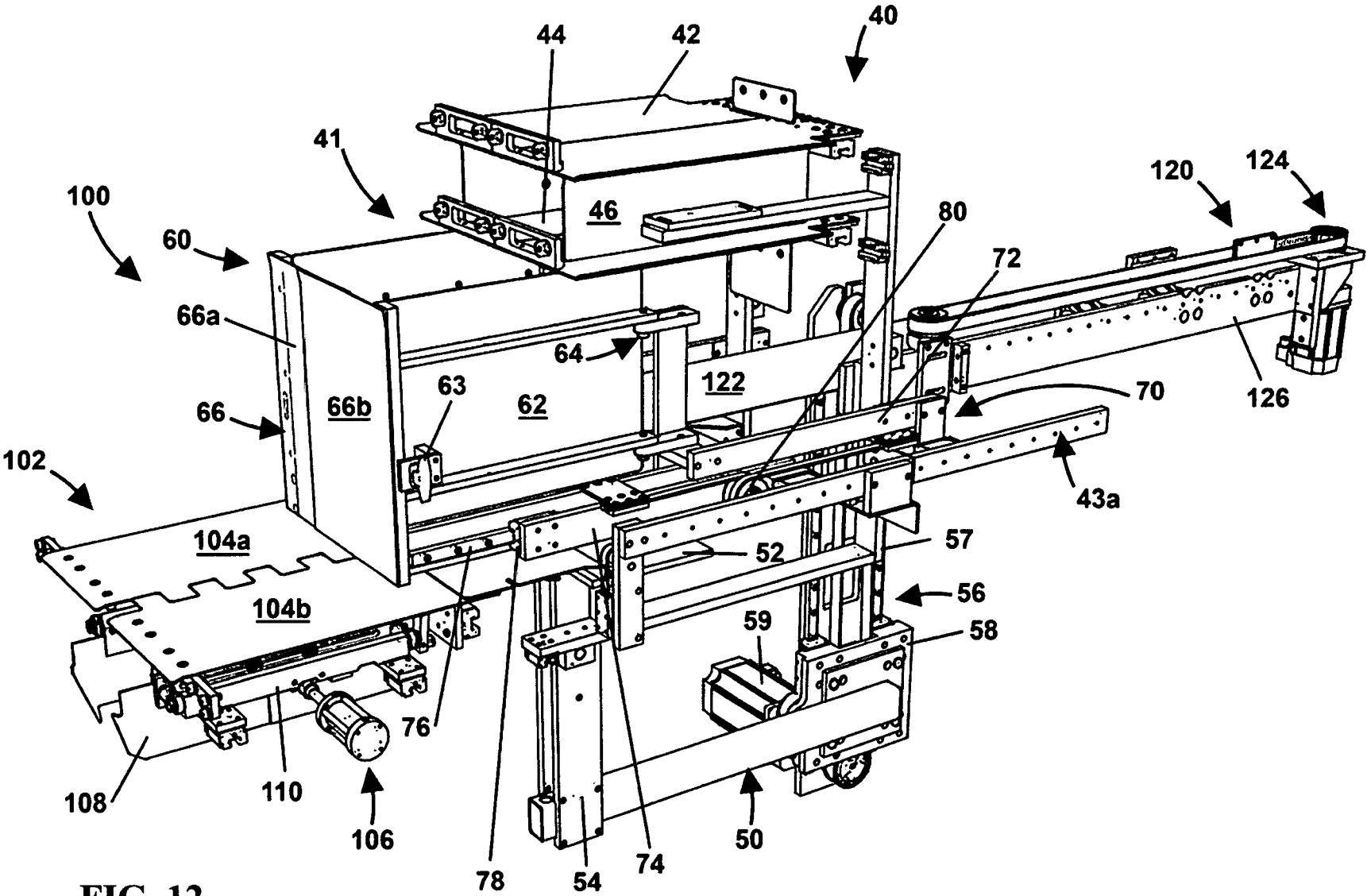
FIG. 12 depicts the FIG. 11 subassembly configuration, an accumulated article group being transferred in advance of case loading.
Figure 13:
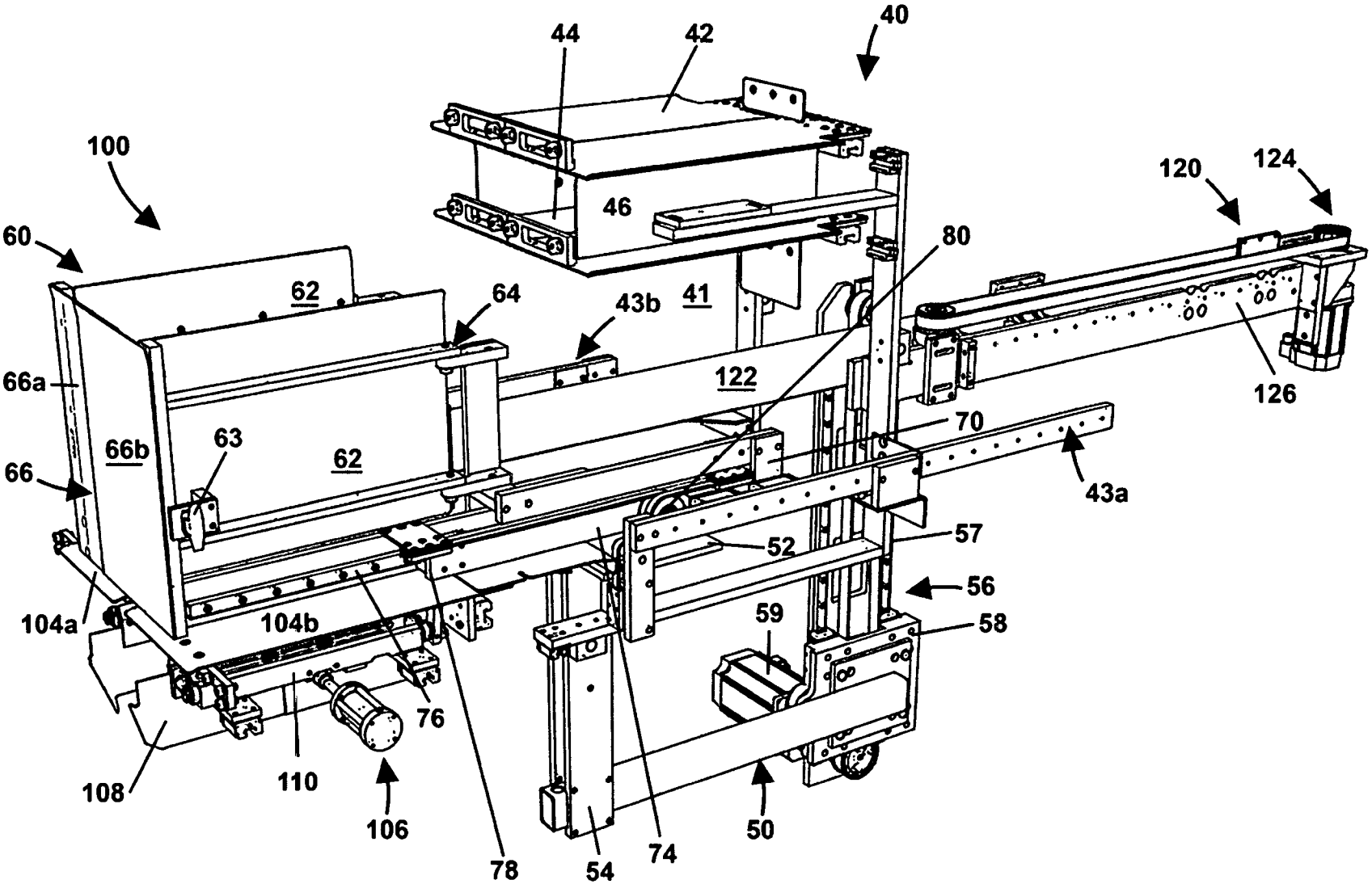
FIG. 13 depicts the FIG. 11 subassembly configuration, a transferred accumulated article group positioned for case loading.
Figure 14:
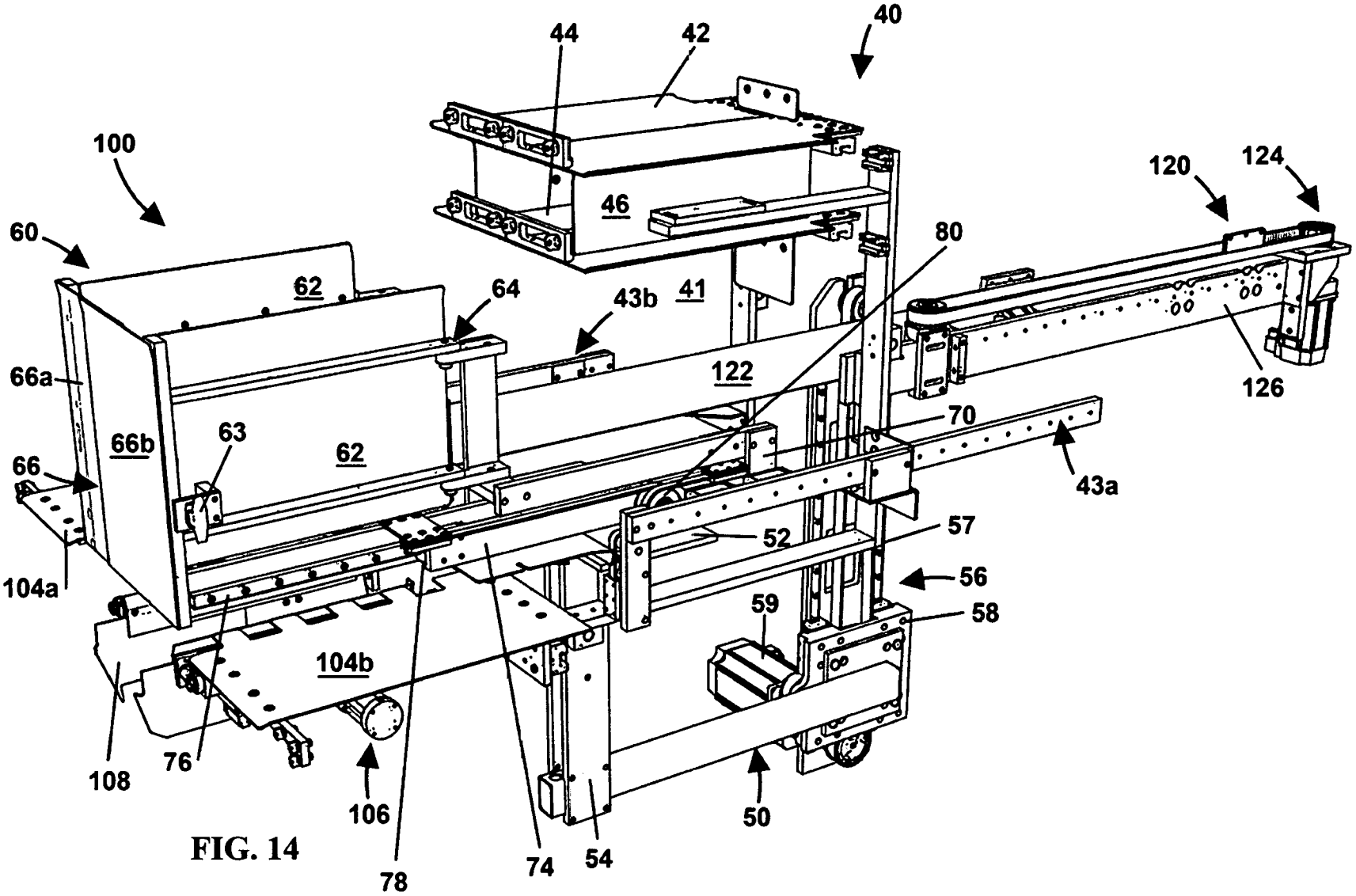
FIG. 14 depicts the FIG. 11 subassembly configuration, the positioned accumulated article group being case loaded (flat pack)
Figure 16:
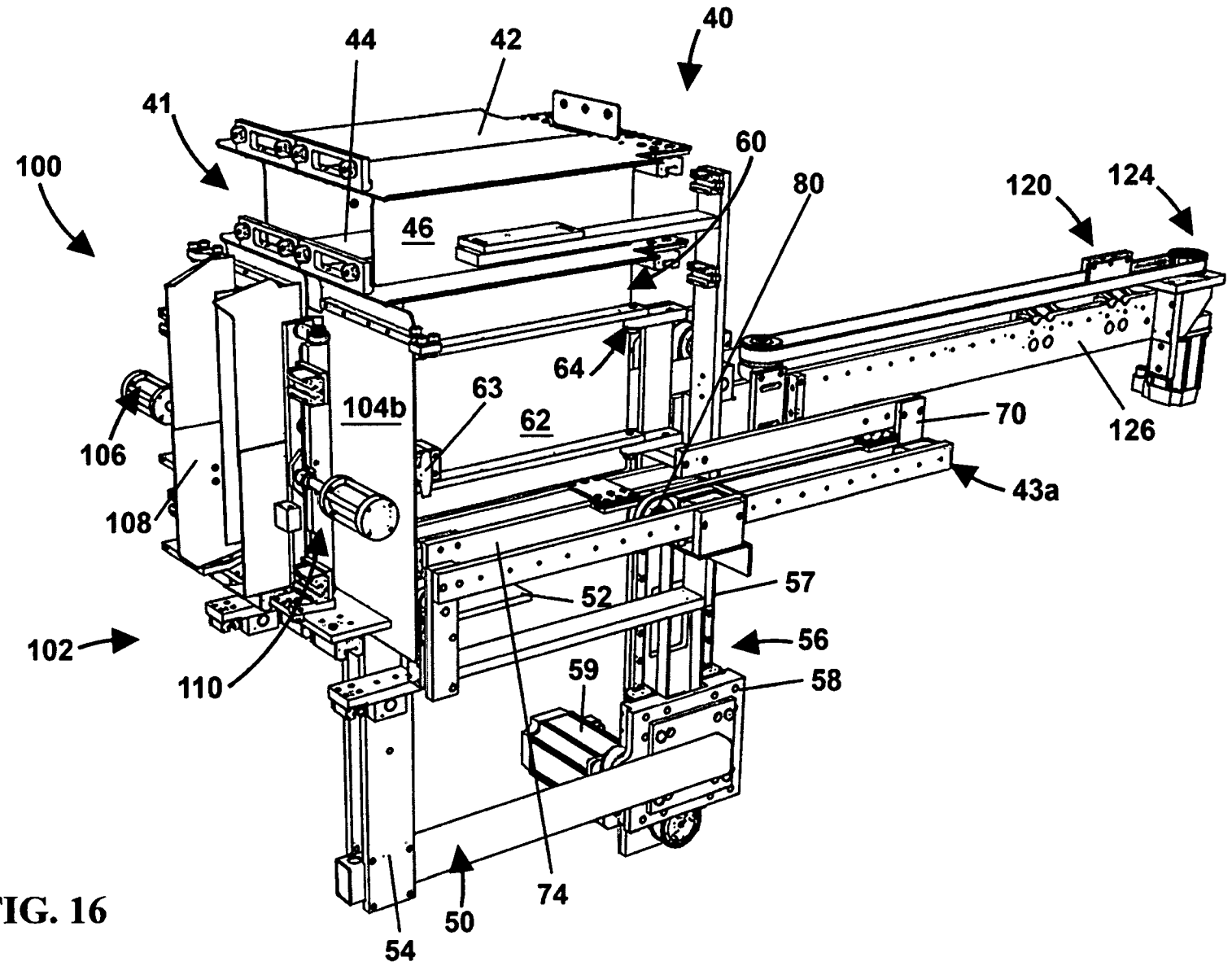
FIG. 16 generally depicts, side perspective view process flow right to left, subassemblies of processing areas III & IV of the contemplated convertible intermittent case packer, operatively configured for vertical packaging operations, articles being accumulated in advance of an article group transfer.
Figure 17:
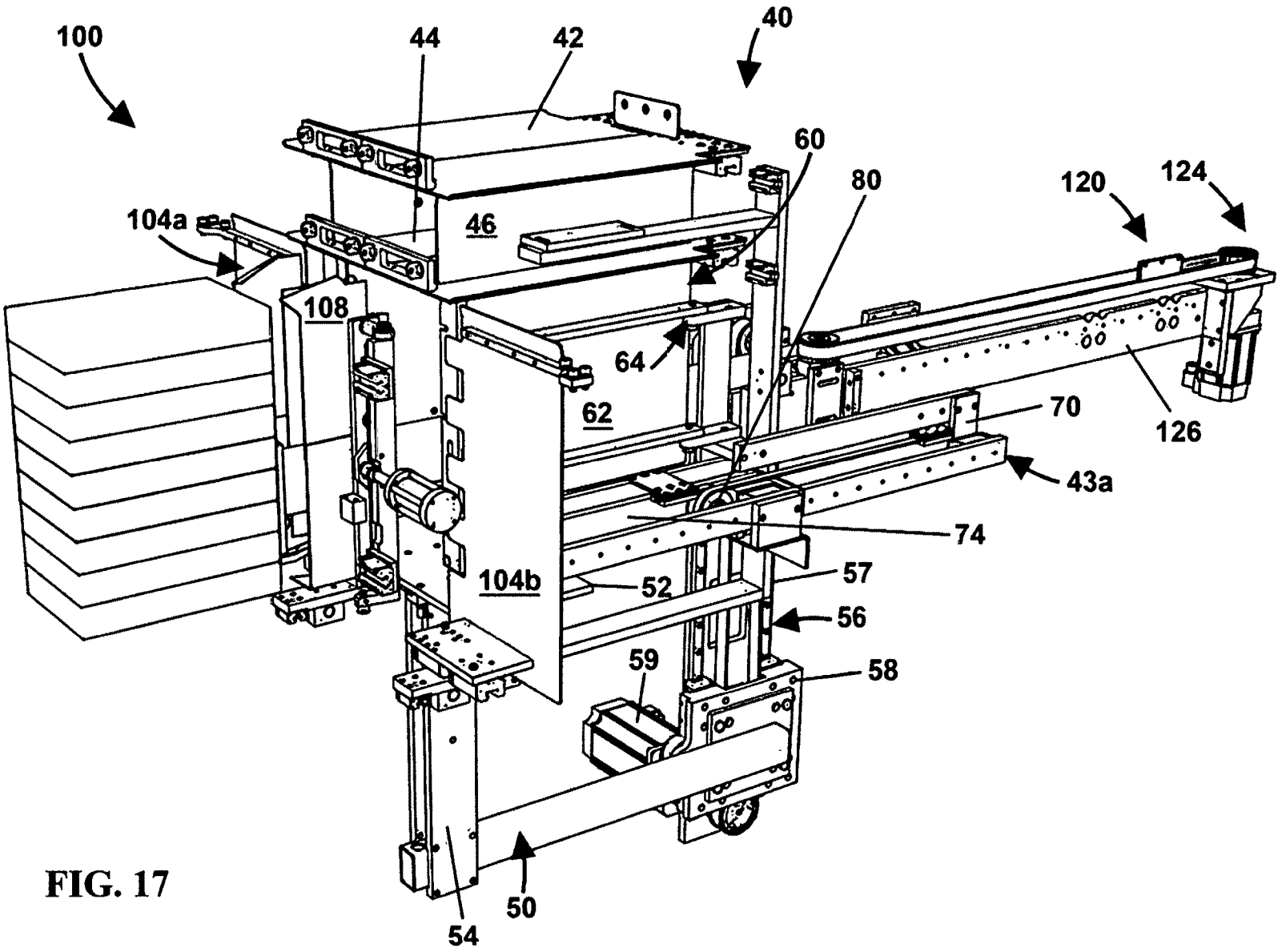
FIG. 17 depicts the FIG. 16 subassembly configuration, an accumulated article group transferringly case loaded (vertical pack)

With continued general reference to FIGS. 11-19 and particular reference to the subassembly configurations of FIGS. 11 & 16, there is illustrated article accumulation station 40 characterized by article receiver assembly 50 and grouped article guide structure 60, grouped article loading station 100 characterized by gate assembly 102, and pusher assembly 120 characterized by actuatable pusher 122. Notionally, the article accumulation station is intermediate the pusher assembly and the grouped article loading station as shown. Moreover, as will be later presented, a cross dimension (z-direction) for the station is selectable, via manipulation of an adjustable framework for same, so as to conform the station to the accumulating article or article pack pattern in the cross machine direction, with an x-dimension for the accumulated article group likewise being selectable, via actuation (i.e., adjustment or resetting of a start position) of the pusher of the pusher assembly.

As a preliminary matter, and with reference to FIG. 11, notionally, a two part framework 43 (e.g., "front" and "rear" frame or framework portions 43*a*, 43*b* as shown) operatively support article receiver assembly 50 and grouped article guide structure 60, indirectly via a guide structure carriage assembly as will be later described. Frame portions 45, 47 are adapted so as to draw one portion to/from the other, or to/from each other. Moreover, as will be readily appreciated subsequently, portions of the grouped article structure are operably supported so as to move with the framing in furtherance of guiding a range of variably dimensioned (z-dimension) accumulated article groups.

Articles exit the article infeed conveyor and "enter" the columnar article accumulation station (e.g., article chute thereof) whereupon the articles are selectively handled during a guided descent in advance of positioning the accumulated article group within the grouped article structure. As should be appreciated, it is desirable/advantageous to selectively conform at least the z-dimension of the chute to the z-dimension of the article or article group or article pack pattern, as via the aforementioned framework, with selective conforming of the x-dimension of the grouped article structure accomplished via adjustment of the pusher of the pusher assembly.

In addition to article receiver assembly 50 and grouped article structure 60, article accumulation station 60 is further and advantageously characterized by a shelf or shelving, e.g., upper and lower shelves 42, 44 as shown. The shelves, which take the form of actuatable doors or gates which traverse the chute in section and open in the z-direction, function to buffer article flow within the chute (i.e., the shelves intermediately collect or capture articles introduced from the article infeed conveyor). As shown, shelves 42, 44 advantageously but not necessarily include first and second shelf portions, each shelf portion adapted to be translating or otherwise separable to permit passage (vertical) of the one of more articles received thereon to a lower shelf or a portion of the article receiver assembly. Opposingly paired sidewalls or panels 46 extend between shelves 42, 44 in furtherance of providing a guided egress from the upper to the lower shelf.

Article receiver assembly 50 generally includes an article receiver, e.g., a platform 52 as shown (see especially FIG. 15), a support structure in the form of an arm 54, and a vertical track subassembly 56 characterized by a track 57, a carriage 58 and carriage driver, e.g., a servo 59 as shown. The article receiver platform, consistent with robust and versatile article handling aims, is advantageously a change-part, platforms dimensionally selected to generally conform/correspond with the sectional dimension of the article chute of the article accumulation station. Functionally, the article receiver ascends/descends to and through the grouped article guide structure in furtherance of receiving articles or article sub groups discharging from the shelf/shelving overlying the guide structure and positioning an accumulated article group within the guide structure.

The grouped article guide structure functions to align or orient, and/or maintain the alignment or orientation of articles of the accumulated article group positioned with respect thereto by the platform of the article receiver assembly. Guide structure 60 is operatively supported by assembly framework 43 via carriage assembly 70. As best appreciated with reference to the sequence of FIGS. 11-13, carriage assembly 70 is advantageously, but not exclusively, characterized by a primary carriage 72 supporting a secondary carriage 74, primary carriage 72 operably united with assembly framework 43, secondary carriage 74 operably uniting guide structure 60 to primary carriage 72.

As is readily appreciated with continued reference to FIGS. 11-17, carriages 72, 74 are generally characterized by conventional elements, such as, but not limited to, track segments 76, track blocks 78 and a drive assembly 80 to impart the sought after motion. Notionally, guide structure 60, or elements thereof, are operably linked or united with carriage assembly 70 for select reversible translation so as to position or locate an accumulated article group positioned within the guide structure for flat packing at the grouped article loading station (compare FIGS. 11-14 with FIG. 16-19, wherein the carriage is active as to the former, via an operable link to/with the pusher of the pusher assembly, and inactive as to the latter).

Grouped article guide structure 60 is generally and minimally characterized by wall forming major guide panels 62 (FIGS. 11-17). Major guide panels 62 extend, as shown, in the z-direction or dimension, intending to longitudinally bound the accumulated article group positionable therebetween, and further generally extend, in the y-direction or dimension, between a portion of the secondary carriage and the lowermost shelf. Major guide panels 62 are supported by carriage assembly 70, more particularly and advantageously, but not necessarily, indirectly supported by secondary carriage 74 via a hinge assembly 64. Via such arrangement, major guide panels 62 are readily pivotable upon release of a latch 63 or the like to access the space delimited or bounded by the major guide panels in furtherance of inspection and/or maintenance tasks, e.g., and without limitation, to facilitate change part operations in connection flat to vertical pack operation conversion as will be subsequently described (FIGS. 16-19).

Grouped article guide structure 60 is further characterized by a minor guide panel or minor guide panels 66 as processing necessitates, minor guide panels 66 operably combinable or coupleable to other structures of article receiver assembly 50 and/or grouped article guide structure 60. By way of illustration, there is shown a "distal" minor panel (e.g., FIGS. 11-14), advantageously but not necessarily, a panel having first and second portions 66*a*, 66*b* (see especially FIG. 15), and a "proximal" minor panel (FIG. 18), the relative notions of proximal and distal cited with reference to/in relation to pusher 122 of pusher assembly 120 (FIG. 19).

Each of minor panels 66 are, as previously noted, operably coupleable/combinable and, selectively, readily and easily disintegrable from elements of grouped article guide structure 60 (i.e., in relation to the distal minor panel, see FIG. 15; in relation to the proximal minor panel, see FIG. 18) in furtherance of select flat or vertical pack operations, with the proximal minor panel contemplated/provided as a change part (FIG. 18) in furtherance of both previously described z-dimension frame adjustability and conversion between flat and vertical pack operations. More particularly, the distal minor panel is decoupleable from/in relation to the major guide panels, and removable part-and-parcel of operational conversion (FIG. 15); the proximal minor panel is likewise decoupleable from/in relation to the major guide panels part-and-parcel of operational conversion (FIG. 17), and removable as a change part (FIG. 18, e.g., 66' for flat pack operations, combinable with major panels in furtherance of formation of/delimiting a grouped article guide "sleeve" characterized by fixedly linked major and minor panels, or 66" for vertical pack operations wherein the proximal minor wall is actuatable to pass between the major guide panels in furtherance of passing an accumulated article group through the actuatable gate.

With particular reference now to FIGS. 11 & 13-17 of FIGS. 11-19, gate assembly 102 is generally and fairly characterized by actuatable gate or keeper 104, a gate actuation subassembly 106, case loading assists 108, and a framework 110 to which/within which the instant components are operably united/supported. A transfer deck 112 (FIGS. 11 & 15) is utilized to conveyingly link the adjacent stations (i.e. article accumulation station 40 to/with grouped article loading station 100). As is best appreciated with reference to FIGS. 3 & 15, and in keeping with the disclosure to this point, gate assembly 102 is hingedly or pivotably supported in relation to the subsystem/subassembly to as to be pivotingly actuated about point P in conversion from its FIG. 11-14 orientation to its FIG. 16-18 orientation.

Gate 104 advantageously, but not necessarily includes first and second gate portions 104*a*, 104*b*. Each gate portion 104*a*, 104*b* is carriage or otherwise mounted within/with respect to gate assembly framework 110 for opposing reversible translation, relative to each other, in the z-dimension (see/compare, e.g., FIGS. 13 & 14 relative to flat pack operations and FIGS. 16 & 17 relative to vertical pack operations) to permit passage of an accumulated article group therethrough.

With particular reference now to FIG. 19 of FIGS. 11-19, pusher assembly 120 is generally and fairly characterized by actuatable pusher 122, a pusher actuation subassembly 124, and frame or framework 126 to which/within which the instant components are operably united/supported. Pusher 122 is carriage or otherwise mounted within/with respect to pusher assembly framework 126 for opposing reversible translation in the x-dimension, home/load pusher comparative arrangements depicted in relation to FIGS. 11 & 13 on one hand, and FIGS. 16 & 17 on the other hand.

Figure 18:
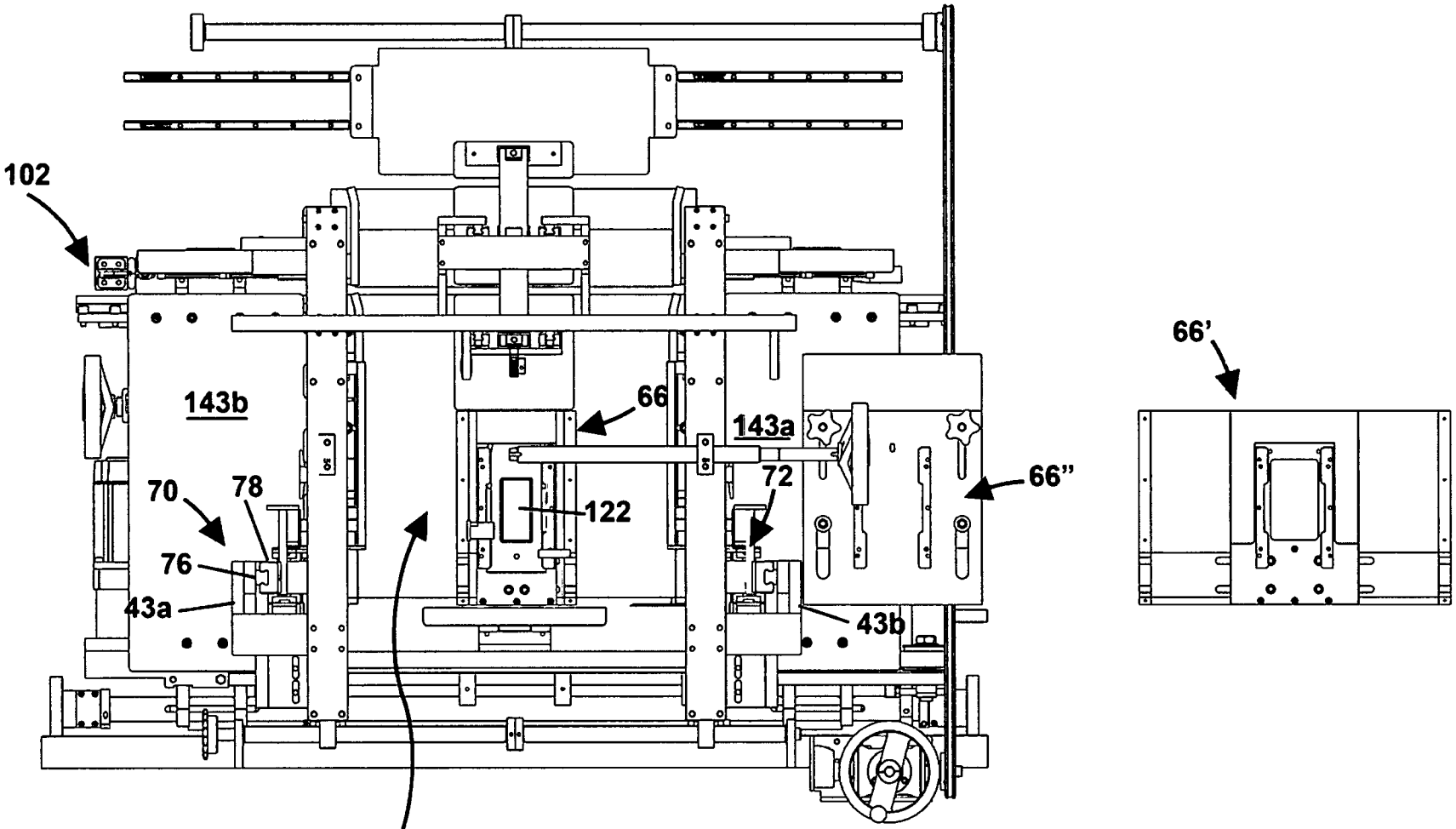
FIG. 18 depicts an upstream end elevation of the FIG. 16 subassembly configuration, with change parts illustrated figure right; and, FIG. 19 depicts a pusher assembly of the FIG. 16 subassembly, portions thereof eliminated for the sake of clarity, the pusher thereof depicted in a home position (left) and extended position (right).
Figure 19:
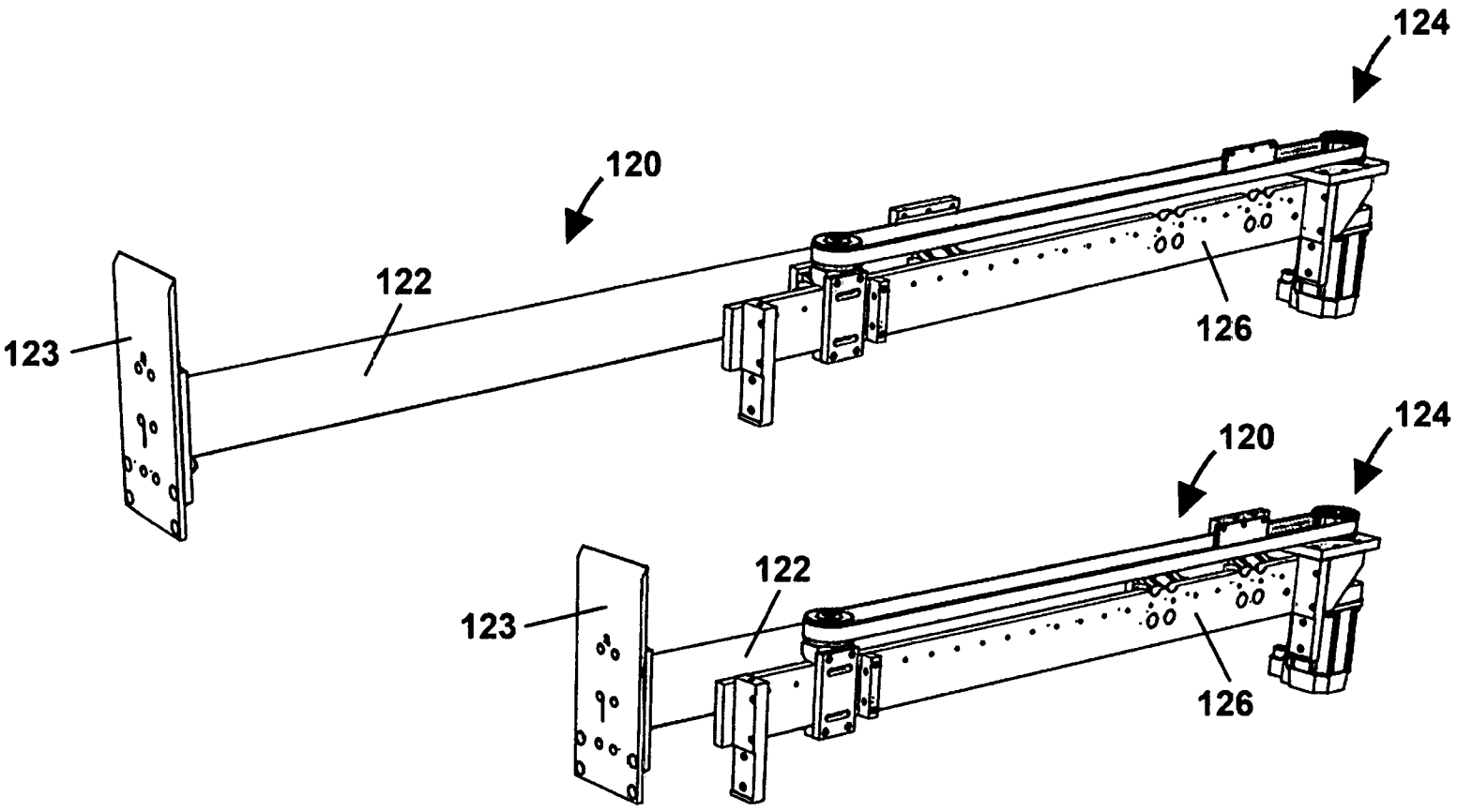

As is best appreciated with reference to FIGS. 18 & 19, a free end 123 of pusher 122 is adapted for receipt of proximal minor guide panel 66, which as previously noted, is advantageously present in the subassembly as a change part. Notionally, the pusher acts upon the accumulated article group, advantageously, indirectly, in furtherance of transferring the accumulated article group from the article accumulation station to the grouped article loading station.

Proximal minor guide panel 66 is supported by (i.e., affixable to) free end portion 123 of pusher 122. During flat pack operations, the proximal minor guide panel (e.g., minor guide panel 66', FIG. 18) is part and parcel of sleeve like guide structure 60 (see e.g., either of FIGS. 5-10, or FIGS. 11-14), actuation of the pusher resulting in translation of sleeve like guide structure 60, via its carriage mount (i.e., union of major guide panels 62 with carriage 70), so as to effectively transfer the accumulated article group surrounded thereby over gate 104 of gate assembly 102 for subsequent release into an awaiting case therebelow. During vertical pack operations, the proximal, and only minor guide panel (e.g., minor guide panel 66", FIG. 18) is not united with either of major guide panels 62, the proximal guide panel being reversibly passed through the resulting stationary, opposingly paired major guide panels such that the accumulated article group is transferred to grouped article loading station 110, through gate 104 of gate assembly 102 and into an awaiting case.

While advantageous, non-limiting systems, subsystems, apparatuses, assemblies, subassemblies, and/or methods for intermittent case packing are depicted, described and/or readily ascertained with reference to the instant disclosure, alternate not insubstantial functional equivalents are likewise contemplated to effectuate a sought after and described robust functionality. Presently known and future developed means for effectuating the noted functionalities are understood to be within the scope of the instant disclosure.

Thus, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

What is claimed is:

1. A system for loading an accumulated article group into a case, the system comprising:

a. an article accumulation station comprising an article receiver assembly for aggregatingly receiving articles in furtherance of delimiting an accumulated article group, and a grouped article guide structure within which accumulating articles are positionable by operation of said article receiver assembly;

b. a grouped article loading station comprising a gate assembly having first and second operable orientations within said grouped article loading station, said gate assembly having an actuatable gate, the accumulated article group passing through said actuatable gate from said article accumulation station during loading of the accumulated article group into a case presented for receipt of the accumulated article group; and, c. a pusher assembly comprising a pusher effectuating a transfer of the accumulated article group from said article accumulation station to said grouped article loading station and through said gate of said gate assembly, flat packing operations effectuated via transfer of said grouped article guide structure, and thus the accumulated article group therein, over said actuatable gate of said first operably oriented gate assembly by said pusher, vertical packing operations effectuated via transfer of the accumulated article group to said actuatable gate of said second operably oriented gate assembly.

2. The system of claim 1 wherein said gate assembly is pivotable.

3. The system of claim 1 wherein said gate assembly is pivotable between said first and second operable orientations.

4. The system of claim 1 wherein said gate assembly includes panels for cooperative engagement with flaps of the case to aid grouped article case loading during passage of the accumulated article group through said gate.

5. The system of claim 1 wherein said article receiver assembly includes an actuatable article group platform for aggregating receipt of articles, said actuatable article group platform passable through said article guide structure so as to position the accumulated article group therein.

6. The system of claim 1 wherein said article accumulation station further comprises an actuatable article layering shelf to buffer the flow of articles within said article accumulation station.

7. The system of claim 1 wherein said article accumulation station further comprises spaced apart actuatable article layering shelves, said spaced apart actuatable layering shelves to buffer the flow of articles within said article accumulation station.

8. The system of claim 1 wherein said article accumulation station further comprises an adjustable frame structure, said grouped article guide structure operably united therewith for adjustment in furtherance of adapting to a select dimension of a formed article group.

9. The system of claim 1 wherein said grouped article guide structure comprises a sleeve.

10. The system of claim 1 wherein said grouped article guide structure comprises a sleeve, said sleeve operative supported upon a carriage and coupleable to said pusher for translation thereby/therewith.

11. The system of claim 1 wherein said grouped article guide structure comprises a sleeve having opposingly paired sidewalls.

12. The system of claim 1 wherein said grouped article guide structure comprises a sleeve having opposingly paired sidewalls, said pusher of said pusher assembly advanceable therethrough.

13. The system of claim 1 wherein said grouped article guide structure comprises a sleeve having opposingly paired actuatable sidewalls.

14. The system of claim 1 wherein said grouped article guide structure comprises a sleeve having opposingly paired sidewalls and a removable end wall.

15. The system of claim 1 wherein said grouped article guide structure comprises a sleeve having opposingly paired sidewalls and opposingly paired end walls.

16. The system of claim 1 wherein said grouped article guide structure comprises a sleeve having opposingly paired sidewalls and opposingly paired end walls, an end wall operably coupleable with said pusher of said pusher assembly so as to be translatable therewith.

17. The system of claim 1 wherein said grouped article guide structure comprises a sleeve having opposingly paired sidewalls and opposingly paired end walls, a first end wall operably coupleable with said pusher of said pusher assembly, a second end wall adapted for disintegration from said sleeve.

18. The system of claim 1 wherein said grouped article guide structure comprises wall forming major guide panels for longitudinally bounding the accumulated article group positionable therebetween.

19. The system of claim 1 wherein said grouped article guide structure comprises wall forming major guide panels for longitudinally bounding the accumulated article group positionable therebetween, and a minor guide panel operably coupleable to/with structures of said article receiver assembly and/or said grouped article structure.

20. A system for loading an accumulated article group into a case, the system comprising:

a. an article accumulation station comprising an article receiver assembly for aggregatingly receiving articles in furtherance of delimiting an accumulated article group, and a grouped article guide structure within which accumulating articles are positionable by operation of said article receiver assembly;

b. a grouped article loading station comprising a pivotable gate assembly having an actuatable gate, the accumulated article group passing through said actuatable gate during loading of the accumulated article group into a case presented for receipt of the accumulated article group, said pivotable gate assembly pivotable between a first operational mode wherein said actuatable gate is horizontally oriented and a second operational mode wherein said actuatable gate is vertically oriented; and, c. a pusher assembly comprising a pusher effectuating a transfer of the accumulated article group from said article accumulation station to said grouped article loading station, flat packing operations effectuated via transfer of said grouped article guide structure, and thus the accumulated article group therein, over said actuatable gate in said first operational mode for said pivotable gate assembly by said pusher, vertical packing operations effectuated via transfer of the accumulated article group to said actuatable gate in said second operational mode for said pivotable gate assembly.

21. The system of claim 20 wherein said gate assembly includes panels for cooperative engagement with flaps of the case to aid grouped article case loading during passage of the accumulated article group through said gate.

22. The system of claim 20 wherein said article receiver assembly includes an actuatable article group platform for aggregating receipt of articles, said actuatable article group platform passable through said article guide structure so as to position the accumulated article group therein.

23. The system of claim 20 wherein said article accumulation station further comprises an actuatable article layering shelf to buffer the flow of articles within said article accumulation station.

24. The system of claim 20 wherein said article accumulation station further comprises spaced apart actuatable article layering shelves, said spaced apart actuatable layering shelves to buffer the flow of articles within said article accumulation station.

25. The system of claim 20 wherein said article accumulation station further comprises an adjustable frame structure, said grouped article guide structure operably united therewith for adjustment in furtherance of adapting to a select dimension of a formed article group.

26. The system of claim 20 wherein said grouped article guide structure comprises a sleeve.

27. The system of claim 20 wherein said grouped article guide structure comprises a sleeve, said sleeve operative supported upon a carriage and coupleable to said pusher for translation thereby/therewith.

28. The system of claim 20 wherein said grouped article guide structure comprises a sleeve having opposingly paired sidewalls.

29. The system of claim 20 wherein said grouped article guide structure comprises a sleeve having opposingly paired sidewalls, said pusher of said pusher assembly advanceable therethrough.

30. The system of claim 20 wherein said grouped article guide structure comprises a sleeve having opposingly paired actuatable sidewalls.

31. The system of claim 20 wherein said grouped article guide structure comprises a sleeve having opposingly paired sidewalls and a removable end wall.

32. The system of claim 20 wherein said grouped article guide structure comprises a sleeve having opposingly paired sidewalls and opposingly paired end walls.

33. The system of claim 20 wherein said grouped article guide structure comprises a sleeve having opposingly paired sidewalls and opposingly paired end walls, an end wall operably coupleable with said pusher of said pusher assembly so as to be translatable therewith.

34. The system of claim 20 wherein said grouped article guide structure comprises a sleeve having opposingly paired sidewalls and opposingly paired end walls, a first end wall operably coupleable with said pusher of said pusher assembly, a second end wall adapted for disintegration from said sleeve.

35. The system of claim 20 wherein said grouped article guide structure comprises wall forming major guide panels for longitudinally bounding the accumulated article group positionable therebetween.

36. The system of claim 20 wherein said grouped article guide structure comprises wall forming major guide panels for longitudinally bounding the accumulated article group positionable therebetween, and a minor guide panel operably coupleable to/with structures of said article receiver assembly and/or said grouped article structure.

* * * * *